US005765337A

United States Patent [19]

Lodewegen et al.

[11] Patent Number: 5,765,337

[45] Date of Patent: Jun. 16, 1998

[54] APPARATUS AND METHOD FOR STACKING AND BOXING STACKABLE ARTICLES

[75] Inventors: Lloyd E. Lodewegen, Hastings; David J. Seavey, Champlin; Darrin J. Harder; David R. Brownson, both of Hastings, all of Minn.; Jason S. Lewis, Prescott, Wis.

[73] Assignee: Forpak, Inc., Hastings, Minn.

[21] Appl. No.: 652,009

[22] Filed: May 23, 1996

[51] Int. Cl.[6] ..... B65B 57/00

[52] U.S. Cl. ..... 53/493; 53/244; 53/247; 53/254; 53/532; 53/540; 53/447; 53/475; 91/361

[58] Field of Search ..... 91/361; 53/447, 53/473, 475, 493, 532, 540, 244, 247, 254

[56] References Cited

U.S. PATENT DOCUMENTS

| | | | |
|---|---|---|---|
| 2,849,236 | 8/1958 | Beaulieu . | |
| 3,002,327 | 10/1961 | Kirby . | |
| 3,105,333 | 10/1963 | Desnick . | |
| 3,488,917 | 1/1970 | Oswald et al. . | |
| 3,641,735 | 2/1972 | Daily et al. . | |
| 3,959,951 | 6/1976 | Paules . | |
| 4,106,390 | 8/1978 | Kodaira et al. | 91/361 X |
| 4,192,121 | 3/1980 | Caudle . | |
| 4,236,855 | 12/1980 | Wagner et al. . | |
| 4,260,309 | 4/1981 | Lynn . | |
| 4,328,449 | 5/1982 | Calligaris | 91/361 X |
| 4,358,989 | 11/1982 | Tordenmalm | 91/361 |
| 4,481,451 | 11/1984 | Kautz et al. | 91/361 X |
| 4,600,351 | 7/1986 | Nelson . | |
| 4,679,381 | 7/1987 | Truninger . | |
| 4,736,570 | 4/1988 | Hardage et al. . | |
| 4,756,399 | 7/1988 | Scata . | |
| 4,763,560 | 8/1988 | Sasaki | 91/361 |
| 4,805,379 | 2/1989 | Leibetseder et al. . | |
| 4,817,498 | 4/1989 | Takagi | 91/361 |
| 4,854,111 | 8/1989 | Roberts et al. . | |
| 4,896,582 | 1/1990 | Tordenmalm et al. | 91/361 |
| 4,921,398 | 5/1990 | Fluck . | |
| 5,069,019 | 12/1991 | Lodewegen . | |
| 5,165,218 | 11/1992 | Callahan, Jr. . | |
| 5,218,813 | 6/1993 | Seidel . | |
| 5,218,895 | 6/1993 | Lukich et al. | 91/361 |
| 5,235,796 | 8/1993 | Campbell, III et al. . | |
| 5,239,807 | 8/1993 | Soleri . | |
| 5,259,173 | 11/1993 | Roberts et al. . | |
| 5,403,056 | 4/1995 | Wallace . | |
| 5,431,086 | 7/1995 | Morita et al. | 91/361 |
| 5,438,274 | 8/1995 | Bitar et al. | 91/361 X |

*Primary Examiner*—Daniel Moon
*Attorney, Agent, or Firm*—Merchant, Gould, Smith, Edell, Welter & Schmidt, P.A.

[57] ABSTRACT

A packaging system includes a stacking apparatus which utilizes a supplemental stacking member on a transfer mechanism for receiving at least one article from a conveying mechanism while the transfer mechanism is transferring a stack, such that a new stack is begun prior to completing the transfer of the first stack. This permits a substantially constant supply of articles to be provided continuously to the stacking apparatus without having to interrupt or slow down the flow of articles to the apparatus. The packaging system also includes a boxing apparatus which relies on pneumatically-actuated positioning mechanisms to move stacks of articles to discrete positions within boxes. Both the position and the velocity of the pneumatic mechanisms are utilized as feedback to provide increased speed without compromising positioning accuracy.

11 Claims, 21 Drawing Sheets

APPARATUS AND METHOD FOR STACKING AND BOXING STACKABLE ARTICLES

FIELD OF THE INVENTION

The invention generally relates to packaging systems for packaging stackable articles. In particular, the invention relates to packaging systems for stacking and boxing hamburger patties.

BACKGROUND OF THE INVENTION

Packaging systems for packaging stackable articles are generally known in the art. By a "stackable" article, what is meant is any article that is suitable for being packaged in orderly stacked arrangements. For example, many packaging systems are specifically designed for packaging hamburger patties, cookies, and other disk-shaped articles.

The stacking machines used in these packaging systems typically receive a supply of articles on a conveyor, which are transferred onto a platform or into a sleeve for forming a stack. Often, a backstop may be used to stop the forward motion of articles and direct them onto a stack. In addition, the supporting platform for a stack of articles may move in such a manner that the top or end of the stack remains at a relatively fixed position so that each article falling onto the stack has a similar, controllable trajectory.

One problem associated with conventional packaging systems is that handling discrete stacks once they are formed is often difficult given the relatively continuous supply of articles provided by a conveyor. Many systems attempt to move a carriage upon which a stack is formed away from the trajectory of falling articles. Often, the stack of articles is removed from the carriage, emptied and returned, or alternatively, another empty carriage is moved under the articles. However, in either case, the transference of stacks of articles often requires the flow of articles to be interrupted during the transfer of completed stacks, or at least for the speed and/or distribution of articles to be spread out sufficiently to permit an empty carriage to be provided to the next article after a completed stack.

Starting and stopping of a conveyor is often problematic, and often requires more complex machinery. In addition, lower productivity is obtained since the rate of articles provided to the stacking machine is limited.

Therefore, a substantial need has arisen for a stacking machine which is capable of handling a high throughput of articles, particularly without requiring any interruption of the supply of articles to process multiple stacks.

Another problem associated with packaging systems is that of boxing or loading multiple stacks of articles into boxes or packages. For example, hamburger patties are often loaded into boxes containing 6 to 15 stacks of patties.

However, the placement of individual stacks is often complex and expensive, e.g., using robotic hands driven by expensive electromechanical actuators. Some packaging systems may attempt to avoid this problem by forming multiple stacks of articles concurrently so that individual stacks need not be separately placed. However, these systems also require complex electromechanical systems to be able to handle multiple stacks.

One problem with electromechanical actuators and the like is the high costs associated with such devices. It would be beneficial to use lower cost actuators such as pneumatic cylinders; however, such cylinders are typically limited to moving between two positions (at each end of their movement). In general, pneumatic cylinders have not been controlled to move between discrete positions along the length of a cylinder because they often lack acceptable precision and accuracy when operating at the speeds necessary in many manufacturing environments. This is due, in part, to the compressibility of air, the internal leakage associated with cylinders, and the lack of predictability (e.g., due to environmental effects such as temperature). In addition, pneumatic cylinders generally have a relatively high static friction which makes them difficult to start and stop effectively.

Therefore, a need also exists for a manner of placing stacks of articles into boxes in a fast, economical and reliable manner.

SUMMARY OF THE INVENTION

The invention addresses these and other problems associated with the prior art in providing a packaging system having a stacking apparatus which utilizes a supplemental stacking member on a transfer mechanism for receiving at least one article from a conveying mechanism while the transfer mechanism is transferring a stack. In essence, a new stack is begun prior to completing the transfer of the first stack. This permits a substantially constant supply of articles to be provided continuously to the stacking apparatus without having to interrupt or slow down the flow of articles to the apparatus. Moreover, this permits multiple stacks to be processed in parallel, thereby further increasing the throughput and productivity of the apparatus.

Therefore, in accordance with one aspect of the invention, there is provided an apparatus which includes conveying means for conveying a plurality of articles; stack forming means for receiving the plurality of articles and forming a stack of articles therefrom; and transfer means for transferring the stack of articles from the stack forming means by moving from a first position to a second position. The transfer means includes a supplemental stacking member for receiving at least one article from the conveying means while the transfer means is transferring the stack from the stack forming means. The transfer means transfers the article received on the supplemental stacking member to the stack forming means when returning to its first position.

In accordance with an additional aspect of the invention, a method of stacking articles conveyed in a substantially continuous supply is provided. The method includes the steps of receiving a plurality of articles sequentially on a primary stacking member and forming a first stack of articles thereon; transferring the first stack of articles from the primary stacking member by moving a push assembly from a first position to a second position; receiving at least one article on a supplemental stacking member while the push assembly is transferring the first stack from the primary stacking member; and returning the push assembly to the first position and transferring the article received on the supplemental stacking member to the primary stacking member to begin a second stack of articles. Discrete stacks of articles are thereby transferred from the primary stacking member without interrupting the supply of articles.

The invention addresses additional problems associated with the prior art in providing a boxing apparatus which relies on pneumatically-actuated positioning mechanisms to move stacks of articles to discrete positions within boxes. In preferred embodiments, both the position and the velocity of the pneumatic mechanisms are utilized as feedback to provide increased speed without compromising positioning accuracy. In preferred embodiments, coarse and fine positioning of the mechanisms are used in sequence to balance the speed and accuracy of the mechanisms.

Therefore, in accordance with this additional aspect of the invention, there is provided an apparatus, which includes a pneumatic cylinder having a piston segregating the cylinder into first and second chambers; first and second pressure sources, coupled to the pneumatic cylinder, for respectively pressurizing the first and second chambers to move the piston within the cylinder; and a controller, coupled at least to the first pressure source, for moving the piston to one of a plurality of positions in the cylinder. The controller includes a position sensor for detecting the position of the piston in the cylinder; a velocity sensor for detecting the velocity of the piston in the cylinder; and positioning means, coupled to the position and velocity sensors, for controlling the first pressure source to position the piston to a desired position in the cylinder in response to the position and velocity of the piston.

In accordance with an additional aspect of the invention, there is provided an apparatus for transferring a stack of articles to one of a plurality of stack positions in a box. The apparatus includes a hand assembly for gripping the stack of articles; and stack position selecting means for orienting the hand assembly to one of the plurality of stack positions in the box. The stack position selecting means includes a pneumatic cylinder, coupled to the hand assembly, for moving the hand assembly along a predetermined axis, the pneumatic cylinder having a piston segregating the cylinder into first and second chambers; first and second pressure sources, coupled to the pneumatic cylinder, for respectively pressurizing the first and second chambers to move the piston within the cylinder; and control means for coordinating activation of the hand assembly and the stack position selecting means to transfer the stack of articles to one of the plurality of stack positions in the box, wherein the control means is coupled at least to the first pressure source for moving the piston to one of a plurality of positions in the cylinder corresponding to at least a portion of the plurality of stack positions in the box. The control means includes a position sensor for detecting the position of the piston in the cylinder; a velocity sensor for detecting the velocity of the piston in the cylinder; and positioning means, coupled to the position and velocity sensors, for controlling the first pressure source to position the piston to a desired position in the cylinder in response to the position and velocity of the piston.

According to a further aspect of the invention, a method is provided for controlling a pneumatic cylinder having a piston segregating the cylinder into first and second chambers, the pneumatic cylinder coupled to a pair of pressure sources respectively pressurizing the first and second chambers to move the piston within the cylinder. The method includes the steps of monitoring the position of the piston in the cylinder; monitoring the velocity of the piston in the cylinder; and moving the piston to a selected position by controlling at least one of the pair of pressure sources to move the piston at a first velocity when the piston is outside of a close position proximate the selected position, and to move the piston at a second, lower velocity when the piston is intermediate the close position and the selected position.

The invention addresses further problems associated with the prior art in providing a boxing apparatus which utilizes a removable web which forms a plurality of compartments in an empty box such that when the box is loaded with stacks of articles, the dividers in the web prevent the stacks from falling over or otherwise inhibiting the placement of subsequent stacks. The web may be transferred to an additional empty box once a box has been loaded.

Therefore, in accordance with this further aspect of the invention, there is provided an apparatus for transferring a plurality of stacks of articles into a plurality of stack positions in a box. The apparatus includes a hand assembly for individually transferring stacks of articles into the box; a web disposed within the box, the web including a plurality of dividers which cooperatively form a plurality of compartments in the box which correspond to the plurality of stack positions in the box; and web transfer means for loading the web into the box before the hand assembly transfers stacks of articles into the box, and for removing the web after the hand assembly has completed transferring stacks of articles into the box.

In accordance with another aspect of the invention, a method is provided for loading a box with a plurality of stacks of articles. The method includes the steps of loading an empty box with a web, the web including a plurality of dividers which cooperatively form a plurality of compartments in the box; placing stacks of articles into at least a portion of the compartments formed in the box; and removing the web from the box.

These and other advantages and features, which characterize the invention, are set forth in the claims annexed hereto and forming a further part hereof. However, for a better understanding of the invention, and the advantages and objectives attained by its use, reference should be made to the Drawing, and to the accompanying descriptive matter, in which there is described preferred embodiments of the invention.

BRIEF DESCRIPTION OF THE DRAWING

FIG. 7A shows the mechanism in a closed position, and FIG. 7B shows the mechanism in an open position.

DETAILED DESCRIPTION OF THE PREFERRED EMBODIMENTS

Figure 1:
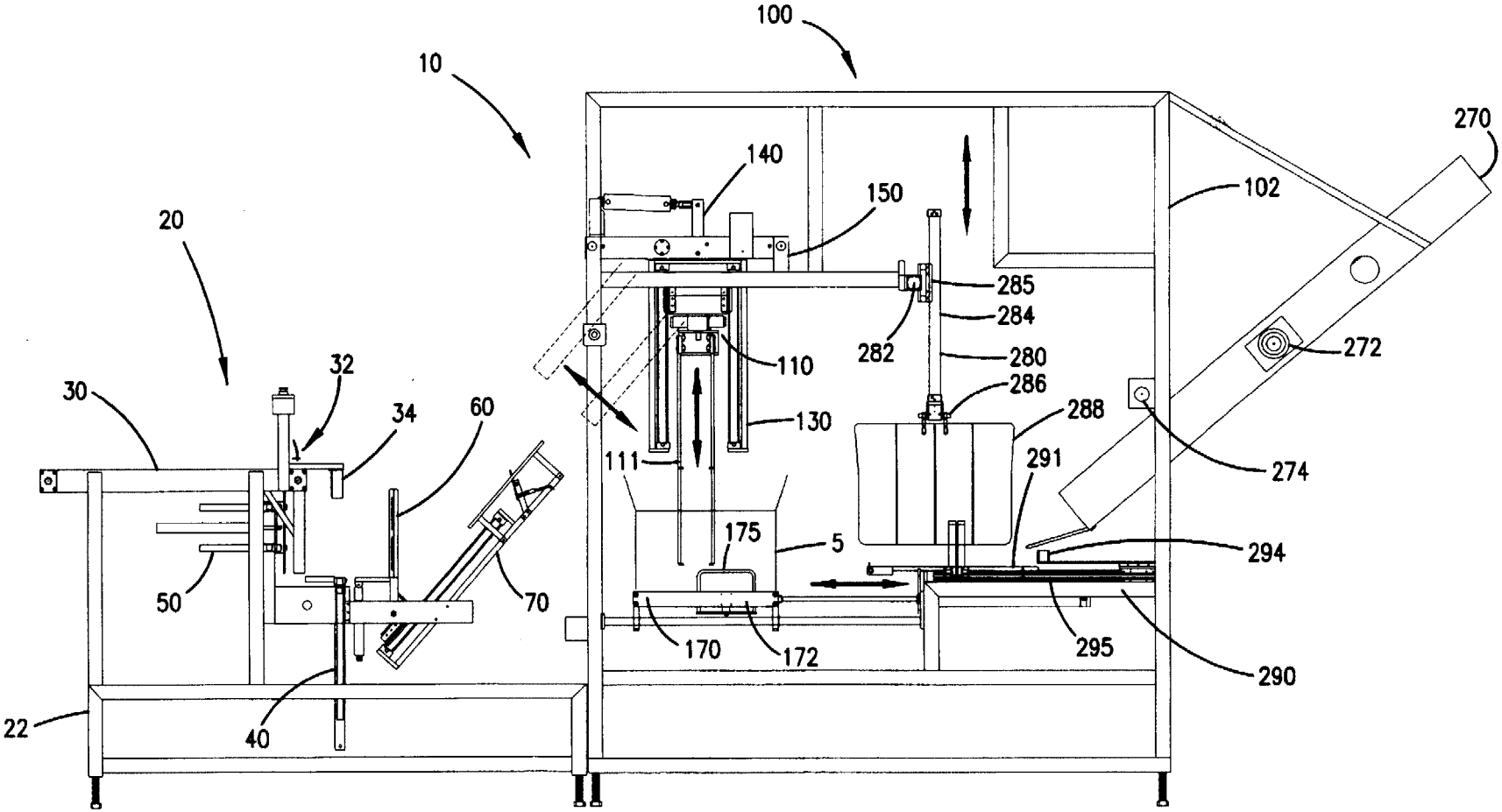
FIG. 1 is a side elevational view of the preferred packaging system consistent with the principles of the invention, with the box transfer station removed for ease of illustration.

Turning to the Drawing, wherein like numbers denote like parts throughout the several views, FIG. 1 shows a preferred packaging system 10 consistent with the principles of the invention. System 10 includes two primary components, a stacking apparatus 20 for producing stacks of stackable articles, and a boxing apparatus 100 for loading the stacks of articles produced by the stacking apparatus into boxes.

Stacking apparatus 20 receives articles conveyed by a conveying mechanism 30. The articles drop onto a stack forming mechanism 40 to form a stack, and completed stacks are transferred to a tilt mechanism 60 by a transfer mechanism 50. Once a stack is received on the tilt mechanism, the stack is tilted and a presentation loader 70 moves the articles generally along the longitudinal axis of the stack to present the stack of articles to the boxing apparatus for loading into a box.

Boxing apparatus 100 is capable of transferring stacks of articles to one of a plurality of positions in a box (e.g., box 5 in FIG. 1). A hand assembly 110 having fingers 111 grips the stacks of articles. A hand extending mechanism 130 extends and retracts the hand assembly along a longitudinal axis thereof, and a hand tilting mechanism 140 tilts the hand assembly between a purely vertical position over a box to an inclined position generally along the longitudinal axis of the stack of articles presented by loader 70. A stack position selecting assembly, including lateral positioning mechanism 150 and box positioning mechanism 170, cooperatively positions the hand assembly over one of a plurality of stack positions in a box so that stacks of articles may be selectively placed in different areas of the box.

Figure 2A:
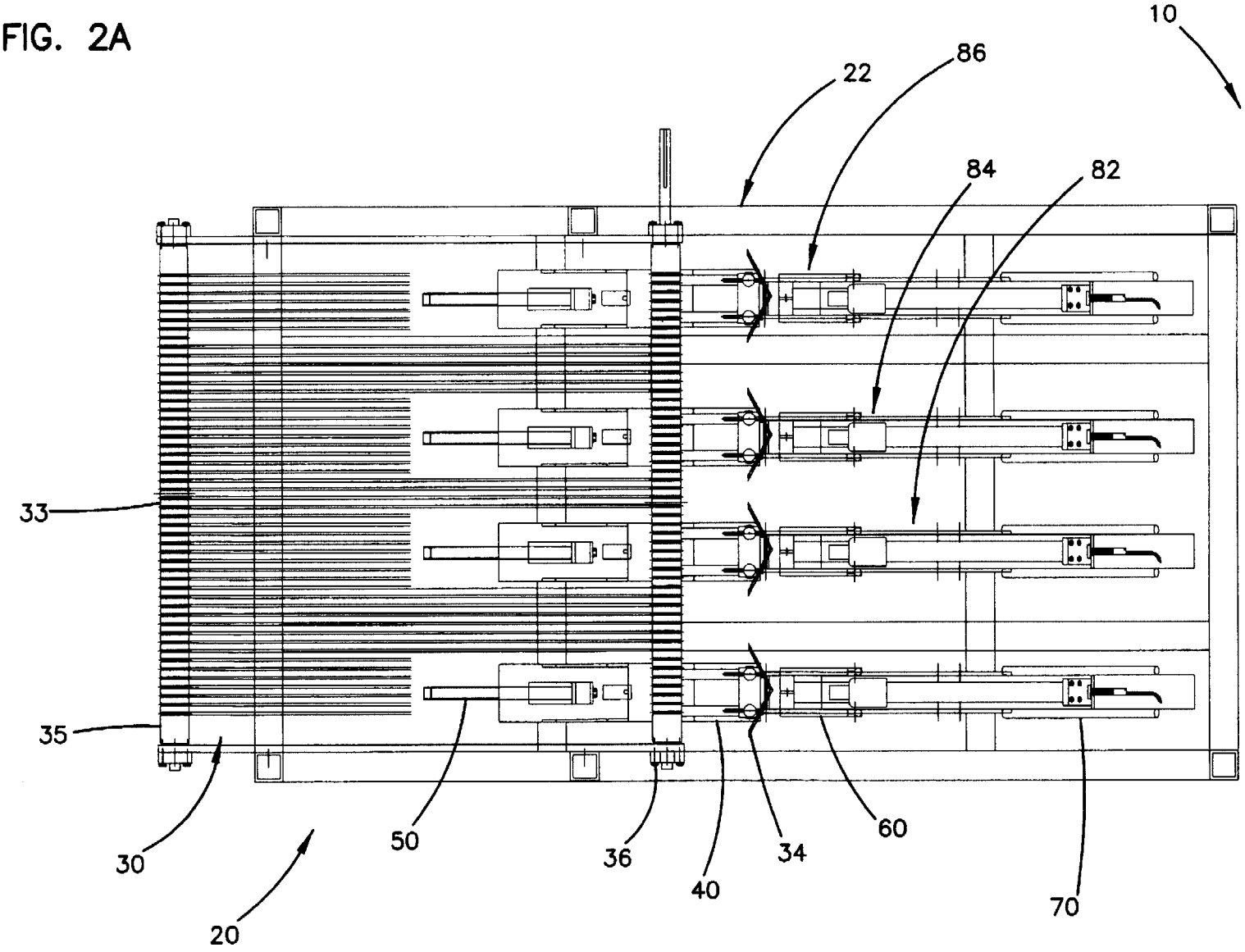
FIG. 2A is a top plan view of the stacking apparatus of FIG. 1, with portions of the conveyor belts cut away to view the transfer mechanisms disposed below the belts.
Figure 2B:
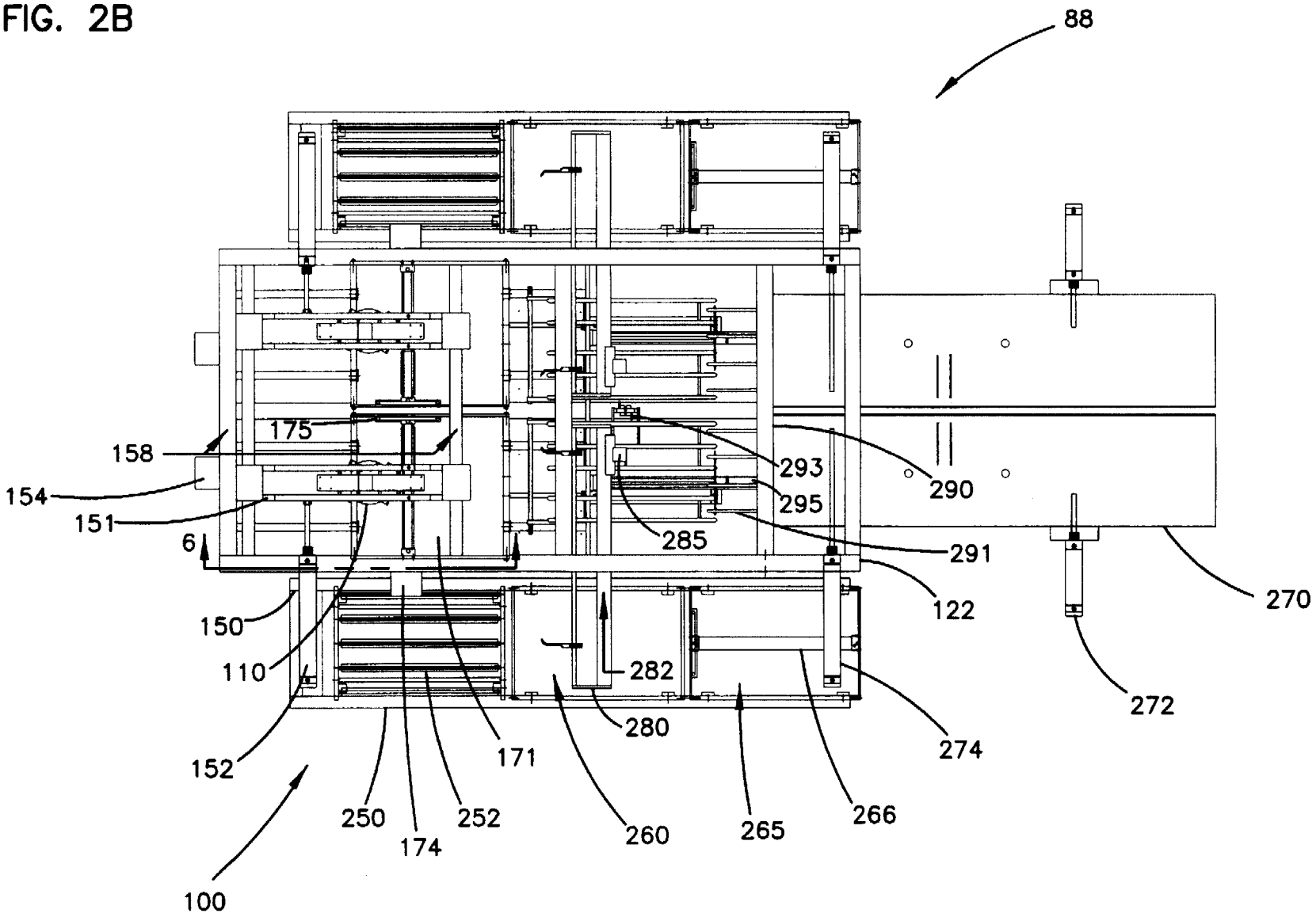
FIG. 2B is a top plan view of the boxing apparatus of FIG. 1.

It will be appreciated that multiple "lanes" or stations may be provided on each portion of packaging system 10. For example, as shown in FIGS. 2A and 2B, the preferred packaging system includes four stacking apparatus 20, 82, 84, 86 which are fed by a common conveyor 30. Two boxing apparatus 100, 88 handle the loading of stacks into boxes, with each handling two of the stacking apparatus. It will therefore be appreciated that other numbers of lanes or stations may be provided in each apparatus consistent with the invention, and moreover that individual conveying mechanisms may be used to feed the individual apparatus.

Moreover, it will be appreciated that while the preferred application is in stacking hamburger patties and loading them into boxes, the invention should not be construed as limited to such operations. For example, the invention has application with innumerable types of stackable articles, such as other meats, cookies, crackers, pastries, food items, or even stackable non-food items. Moreover, the invention has application in loading articles into other packaging. Further, the stacking and boxing apparatus may also be used individually or with other packaging devices.

Stacking Apparatus

Figure 3:
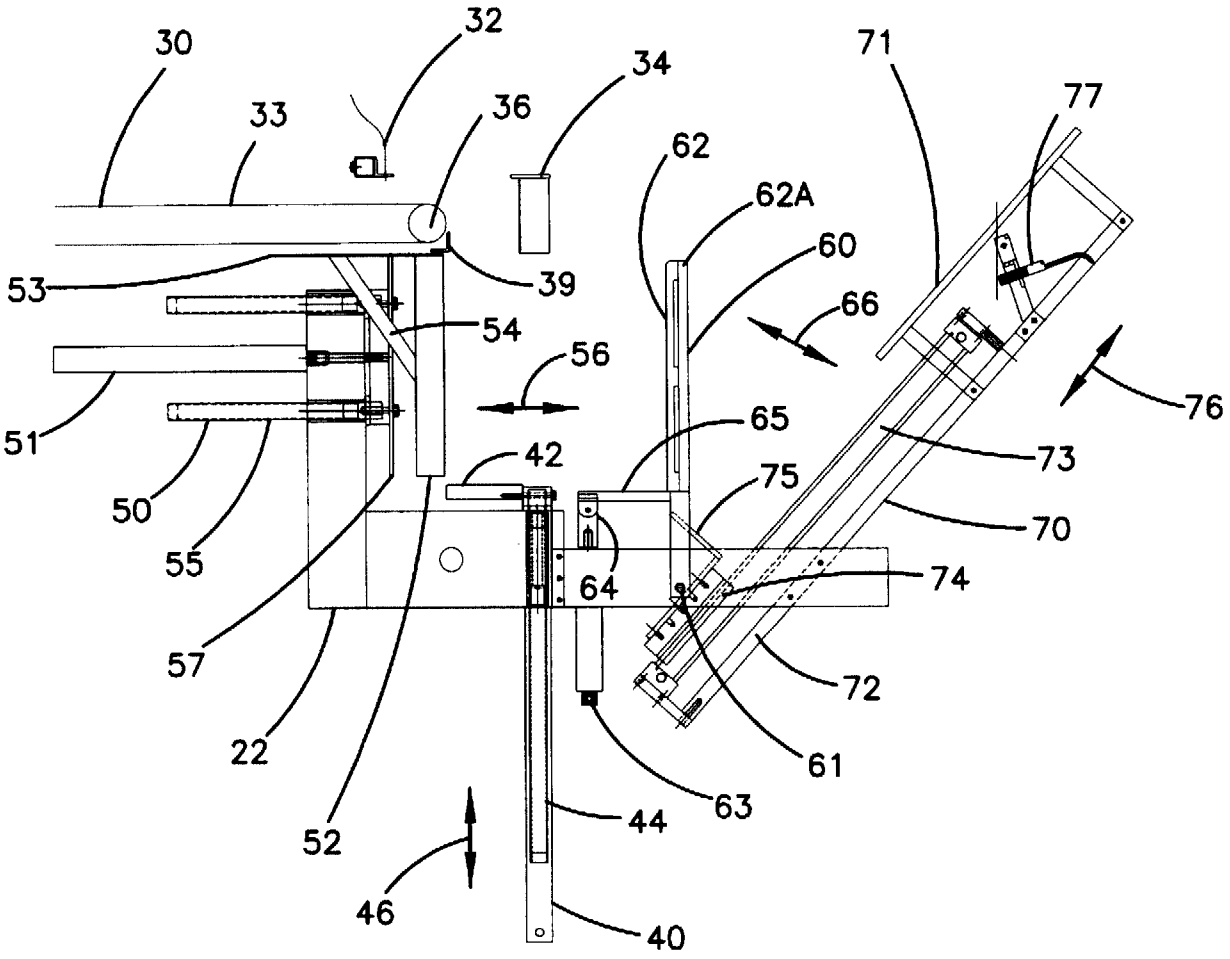
FIG. 3 is an enlarged side elevational view of the primary components in the stacking apparatus of FIG. 1.

FIG. 3 illustrates stacking apparatus 20 in greater detail. It will be appreciated that the other stacking apparatus 82, 84, 86 preferably operate in a similar manner, and thus will not be described separately herein.

As discussed above, conveying mechanism 30 conveys articles to stacking apparatus 20. Mechanism 30 is preferably a conveyor providing a substantially continuous supply of articles. However, it will be appreciated that due to, for example, quality control procedures, selected effective articles may be removed, resulting in a non-uniform supply of articles which, while being continuous, are not of constant distribution.

Conveyor 30 typically receives articles from an additional conveyor (not shown) which transports the articles from another machine.

As shown, for example, in FIG. 2A, conveyor 30 preferably includes continuous belts 33 which are driven between a pair of pulleys 35 and 36 by a prime moving mechanism (not shown in FIG. 2A). A plurality of counters 32 are disposed over the conveyor to count the articles moving on a particular track of the conveyor. The counters are preferably optical sensors, although they may include generally any type of counting device, such as other optical counters, proximity switches, leaf switches, etc.

A back stop is also provided having a plurality of V-shaped stops 34 which are disposed proximate the end of the conveyor such that articles transported by the conveyor will hit the stop and fall onto stack forming mechanism 40. The stops may take any shape consistent with their function, however, it has been found that the V-shaped stops used herein are useful in providing a substantially reproducible trajectory for the articles, and centering for laterally misaligned articles.

Other conveyor mechanisms, such as rollers, pinch rollers, multiple conveyors, etc. may also be used.

Returning to FIG. 3, stack forming mechanism 40 receives articles which drop from stops 34 to form a stack of articles therefrom. The mechanism 40 includes a primary stacking member 42 for supporting a stack of articles thereupon. Member 42 preferably includes a pair of ¾" rods or forks (only one of which is shown in FIG. 3) disposed in a horizontal plane and coupled to a pneumatic cylinder 44 with a fast rapid valve operating as a lift for moving the primary stacking member vertically (i.e., in the direction shown by arrow 46) between upper and lower positions. The cylinder is initially extended to raise the platform proximate the conveyor. Then, as articles are received onto the primary stacking member, the valve releases air pressure periodically to move the primary stacking member downward such that a top surface of the stack of articles is maintained at a generally constant level as articles are added to the stack. Preferably, the primary stacking member is indexed downward after every two patties are counted by counter 32.

Stacking mechanism 40 may take other designs consistent with its function, including other primary stacking member designs, e.g. using a flat platform to support the stack of articles, or other designs which are specifically configured for other types of stackable articles. In addition, while member 42 is shown as substantially horizontal, thereby providing a vertically-aligned stack, it will be appreciated that a stack may be built to be inclined from vertical or even horizontal within the teachings of the invention. Other modifications will be appreciated by one skilled in the art.

Transfer or push mechanism 50 is used to transfer the stack of articles from the stack forming mechanism 40 by moving horizontally from a first, retracted position to a second, extended position (i.e., in the direction shown by arrow 56). Mechanism 50 includes a pair of vertically-extending side members or plates 52 which contact the stack of articles as mechanism 50 is extended. The side members are preferably separated by greater than the width of primary stacking member 42 so that they intermesh and do not hit one another during relative movements thereof. Alternatively, members 52 may be a single member for contacting the stack, however, care must be taken to coordinate the movement of mechanisms 40 and 50.

The motive force for moving mechanism 50 along direction 56 is provided by a pneumatic cylinder 51. Mechanism 50 also includes guides 55 and a transverse plate 57 to provide additional support.

Moreover, a platform 53 is mounted to mechanism 50 transverse to the side members, and is supported by transverse plate 57 and braces 54. Platform 53 operates as a supplemental stacking member for receiving one or more articles (e.g., 3 quarter-pound hamburger patties) from the conveying mechanism while the transfer mechanism is transferring the stack from the stack forming mechanism. As discussed below, this enables the transfer mechanism to transfer the articles received on the supplemental stacking member to the stack forming mechanism when retracting to the first position, since any articles supported on the platform will hit the trailing end of the conveyor if the platform is withdrawn. A stop 39 is mounted proximate the conveyor to dislodge the articles from the supplemental stacking member when mechanism 50 is retracted.

Transfer mechanism 50 may be modified as necessary consistent with the invention. For example, the design of the side plates may be modified depending upon the types of stackable articles used.

Transfer mechanism 50 transfers stacks of articles from stack forming mechanism 40 to a tilting mechanism 60. Mechanism 60 then tilts the stack of articles from a first, substantially vertical orientation to a second, inclined orientation (i.e., in the direction of arrow 66). Mechanism 60 includes a pair of L-shaped members or forks, each of which forms a pair of legs 62, 65. The L-shaped members are preferably separated by a distance less than the width of the stackable articles such that the articles may be supported by the L-shaped members. Primary support for the stack of articles in the first orientation is provided by legs 65, which are coupled to a cylinder 63 through hinged connection 64. Mechanism 60 is in turn connected to frame 22 to pivot about a point 61 such that extension of cylinder 63 will tilt the mechanism to the second orientation.

Legs 62, which cooperatively support the stack of articles in the tilted orientation, preferably include grooves 62*a* which receive rods 71 on the presentation loader mechanism 70. This permits the articles to be slid along legs 62 and rods 71 as they are moved through the presentation loader. Moreover, the interface between legs 62 and rods 71 preferably provides a drop of about ⅝ of an inch such that articles moved along this path are to an extent "shuffled" to promote more orderly stacking. This may be particularly beneficial when used in conjunction with frozen hamburger patties, since the patties may be inclined to stick to one another if any degree of thawing has occurred.

Presentation loader mechanism 70 works in conjunction with tilting mechanism 60 to present a stack of articles to the boxing apparatus 100 for loading into a box. A carriage 74 including an L-shaped support member 75 rides along an inclined path. The carriage is driven by rodless cylinder 73 mounted to inclined frame 72. The L-shaped supporting member 75 preferably has a width which is less than the separation between the L-shaped members (including legs 62, 65) of tilting mechanism 60, such that movement of the L-shaped supporting member 75 is intermeshed with tilting mechanism 60.

Presentation loader 70 is preferably inclined at the same inclination as provided by tilting mechanism 60 in the second orientation. This inclination is preferably about 35° from vertical, although other inclinations may be used in the alternative.

Presentation loader 70 also includes a proximity switch 77 which detects when a stack of patties is presented by the loader. The switch may be used to signal the boxing apparatus 100 that a stack is ready to be moved. In addition, the switch provides verification to the stacking apparatus 20 that a stack has been removed from the loader, so that the loader may be returned to its starting position to receive another stack. Preferably, proximity switch 77 is a No. X54P12MA230L1 switch manufactured by Telemechanic, although other sensing devices may also be used in the alternative.

The various cylinders 44, 51, 63 and 73 used to provide the mode of force for moving articles through stacking apparatus 20 are preferably pneumatic cylinders such as those manufactured by Bimba. The cylinders include necessary control valves (not shown separately) to permit two-way movement. The control of pneumatic cylinders to provide such movement is generally known in the art and is not discussed in greater detail herein.

It will be appreciated that other makes and models of pneumatic cylinders may also be used. In addition, other types of actuators, including hydraulic, electromechanical, etc. may also be used in the alternative.

Figure 5:
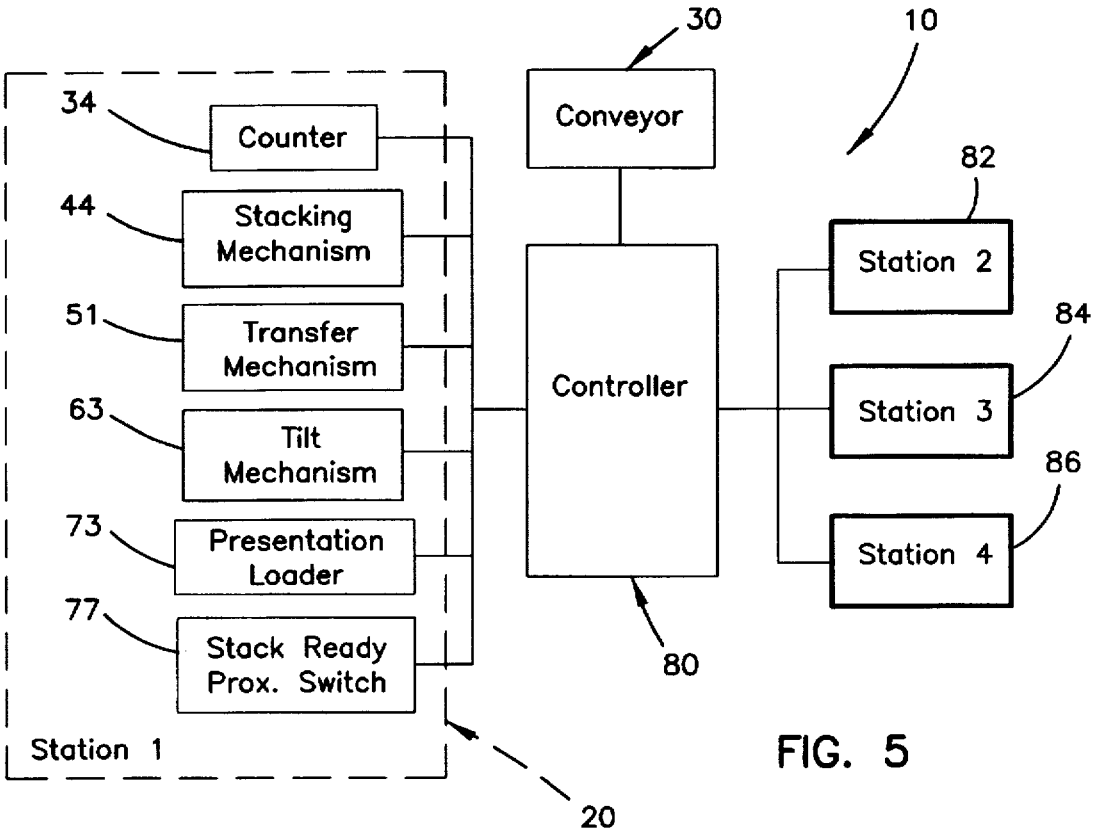
FIG. 5 is a functional block diagram of the control system of the stacking apparatus in FIG. 3.

FIG. 5 is a block diagram of the primary components of stacking apparatus 20, including a controller 80 which coordinates the operation of the stacking, transfer, tilting and presentation loader mechanisms. Controller 80 is preferably a programmable logic controller (PLC) manufactured by Mitsubishi or General Electric, although other programmable controllers may be used in the alternative. Controller 80 preferably controls the drive to the conveyor 30, as well as controls the various components in each station 20, 82, 84 and 86. As different numbers of stations, conveyors, etc. may be provided in packaging system 10, it will be appreciated that different controller configurations may be used. Moreover, multiple controllers may be used to handle different aspects of the operation of the system.

Stacking apparatus 20, which conforms to the first station in packaging system 10, is connected to controller 80 through connections to the various actuators, including stacking mechanism cylinder 44, transfer mechanism cylinder 51, tilt mechanism cylinder 63, and presentation loader cylinder 73. The control over these pneumatic cylinders is generally through their control valves, which may vary depending upon the type of cylinder used. In addition, limit switches may also be provided to determine when a cylinder has moved between its two positions. Moreover, the type of controller required for controlling other types of actuators, such as hydraulic and/or electromechanical actuators, will also vary. The control of these types of devices is generally understood in the art and is therefore not discussed in further detail herein.

Figure 4A:
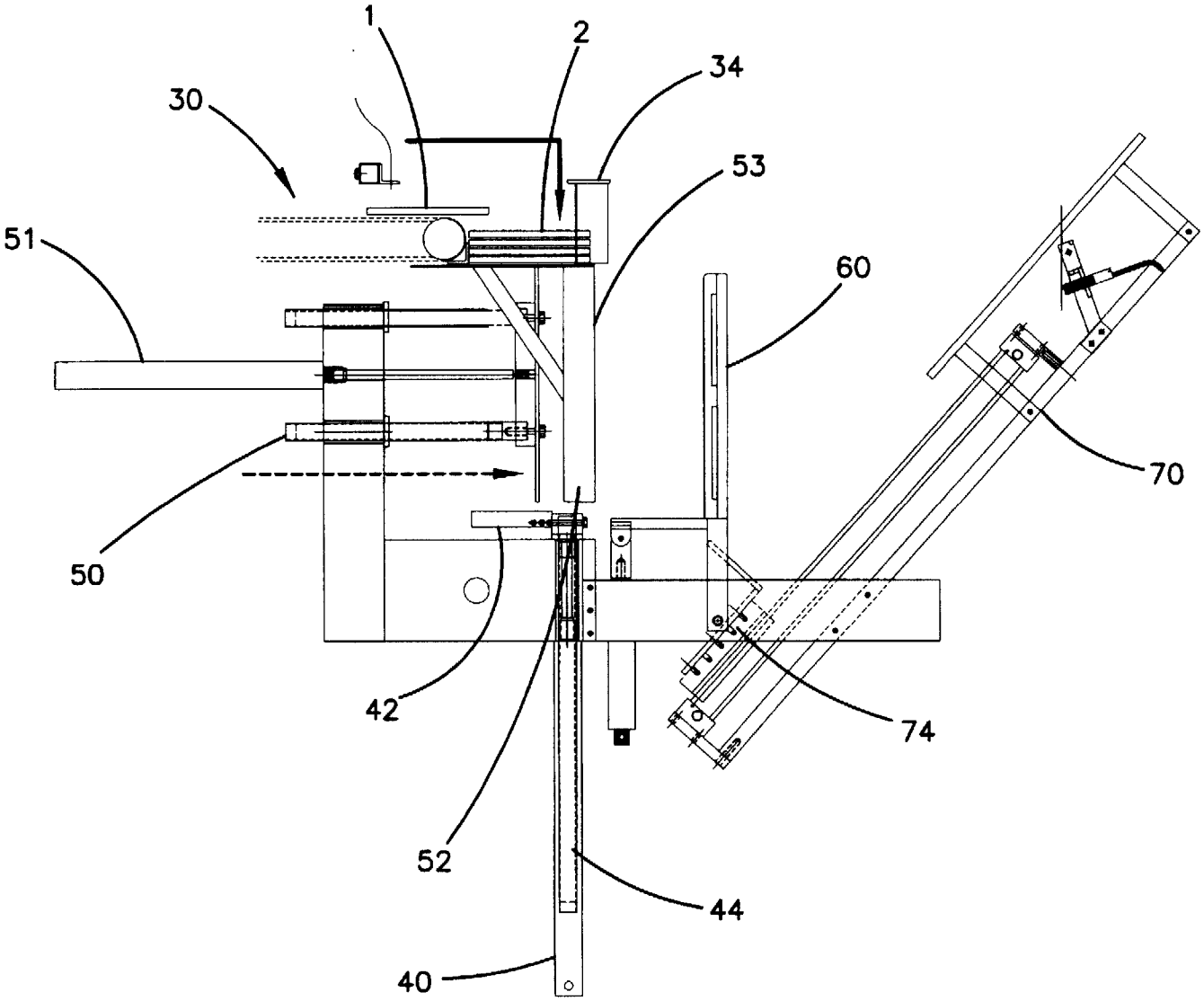
FIGS. 4A–E are side elevational views of the stacking apparatus of FIG. 3 showing various stages of stacking and transferring stacks of articles.

The operation of stacking apparatus 20 is illustrated in greater detail in FIGS. 4A–4E. FIG. 4A shows the initial configuration of the apparatus at the beginning of a cycle. In this configuration, transfer mechanism 50 is extended so that the initial articles 1 supplied on the conveyor hit the stop 34 and fall onto the supplemental stacking member or platform 53 of transfer mechanism 50, forming a first stack 2.

Figure 4B:
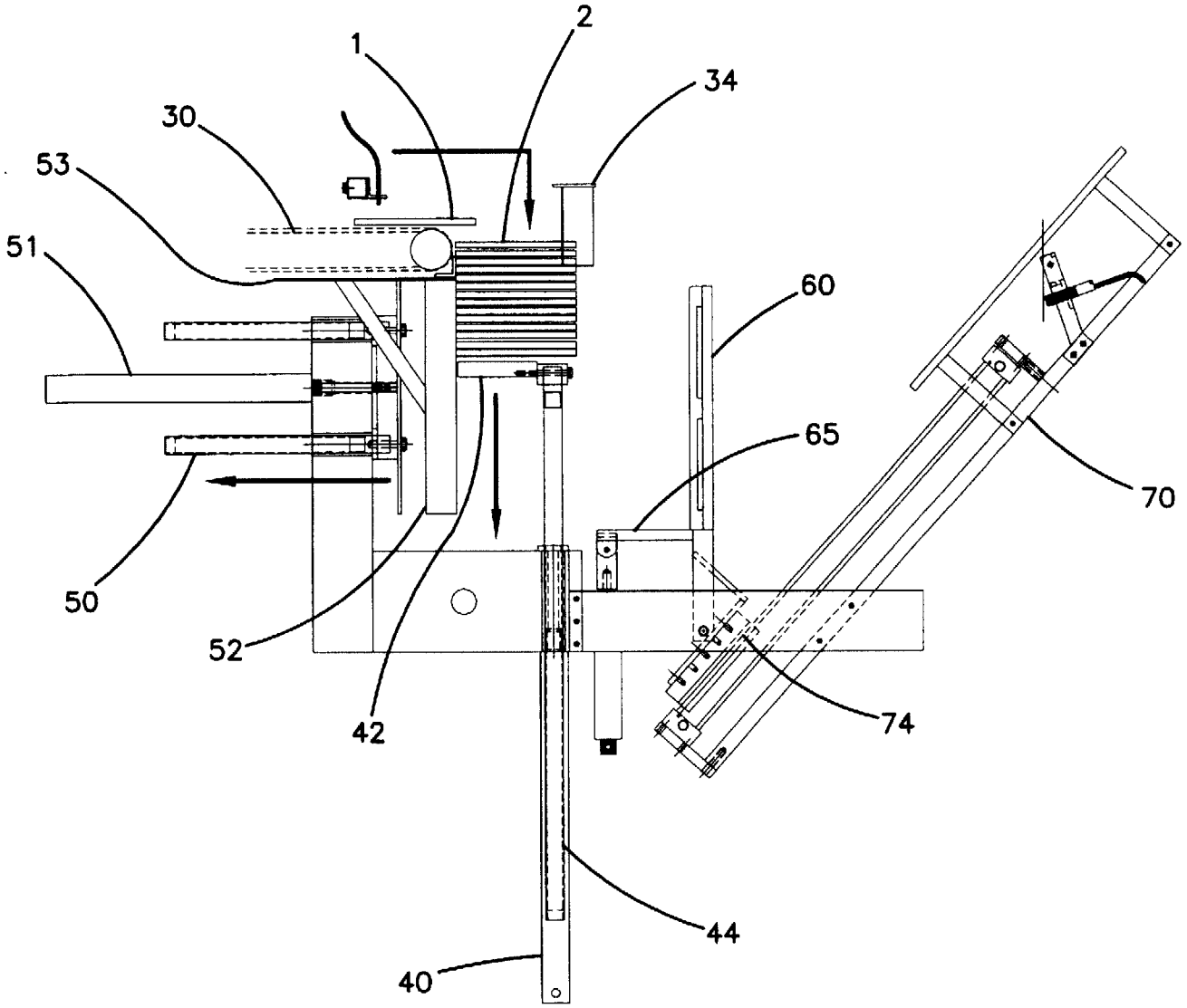

Next, as shown in FIG. 4B, when a predetermined number of articles have been counted by counter 32, transfer mechanism 50 is withdrawn concurrently with the lifting of stack forming mechanism 40 to place primary stacking member 42 in a position to receive the initial articles forming stack 2 on platform 53. As the transfer mechanism is withdrawn, stack 2 is dislodged by stop 39 and drops onto primary stacking member 42. The number of patties which are received by supplemental stacking member 53 prior to withdrawal of transfer mechanism 50 will vary depending upon the type of article. For example, for quarter-pound hamburger patties, the transfer mechanism is preferably withdrawn after three patties have been counted.

In addition, as shown in FIG. 4B, articles 1 continue to be conveyed by conveyors 30 and to fall onto the top of stack 2 formed on primary stacking member 42. Preferably, after every two articles are counted, the valve on cylinder 44 is activated to drop member 42 such that the top surface of stack 2 remains at a substantially constant level and the articles falling from the conveyor fall along a similar trajectory.

Figure 4C:
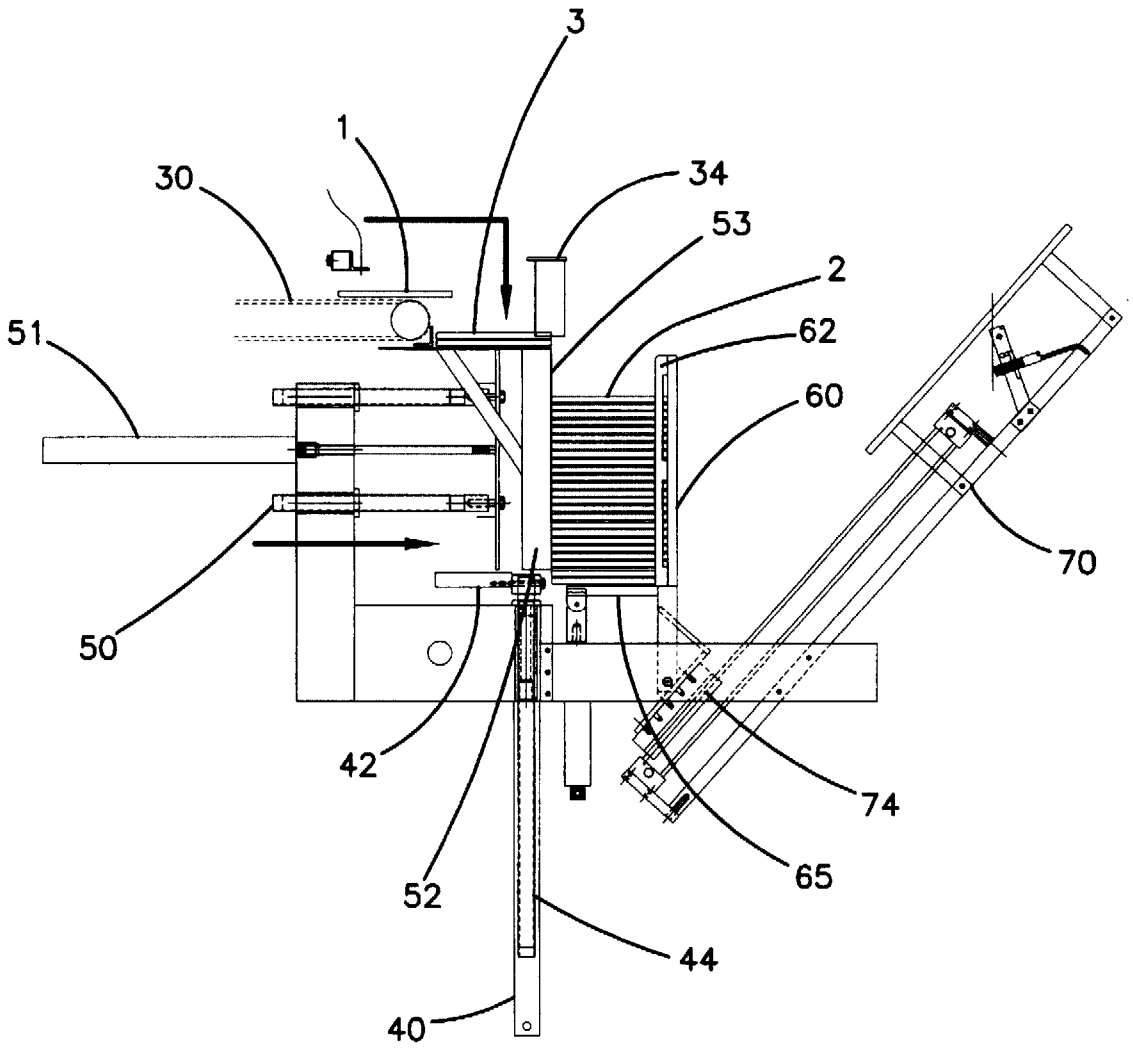

Next, as shown in FIG. 4C, when a predetermined number of articles have been dropped to form first stack 2, the transfer mechanism is activated to push the first stack of articles from primary stacking member 42 onto tilt mechanism 60. During this transfer, side members 52 of transfer mechanism 50 contact the stack and perform the transfer. At this point, platform 42 of stacking mechanism 40 is preferably at about the same level as (most preferably about ⅛" above) legs 65 of tilt mechanism 60 to facilitate the transfer. The number of articles in a stack will vary depending on the type of articles. For example, for quarter-pound hamburger patties, each stack preferably has 24 patties.

As is also shown in FIG. 4C, concurrently with the extension of transfer mechanism 50, additional articles 1 conveyed by conveyor 30 fall onto supplemental stacking member 53 to begin a second stack 3. Consequently, a continuous supply of articles may be provided without interruption due to the transfer of discrete stacks off of stacking mechanism 40 through the use of the supplemental stacking member 53.

Figure 4D:
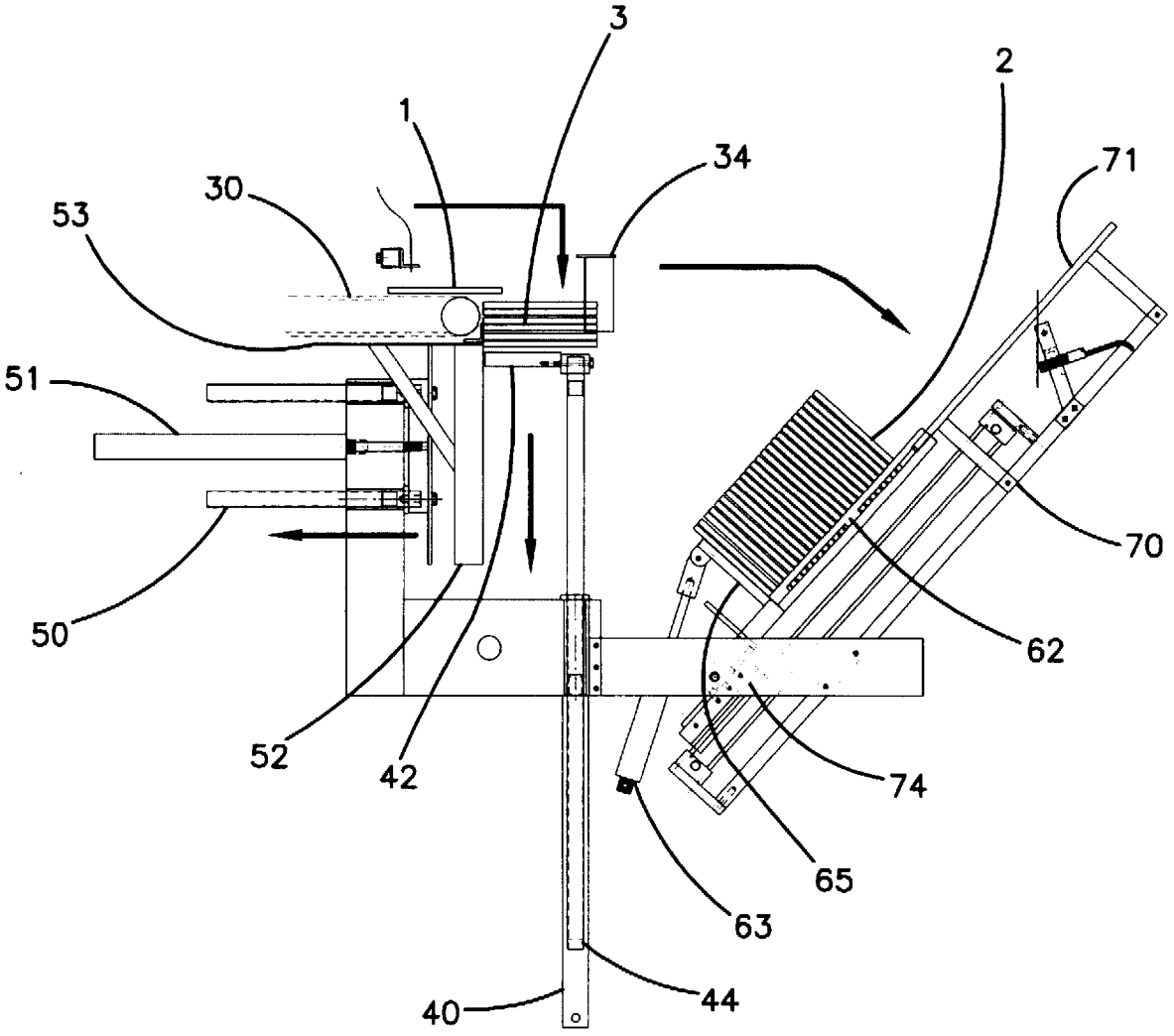

Next, as shown in FIG. 4D, first stack 2 is tilted by tilt mechanism 60 to a second, inclined orientation. Concurrently with this operation, transfer mechanism 50 is retracted and stacking mechanism 40 is raised such that second stack 3 of articles falls onto primary stacking member 42 as discussed above with relation to FIG. 4B.

Figure 4E:
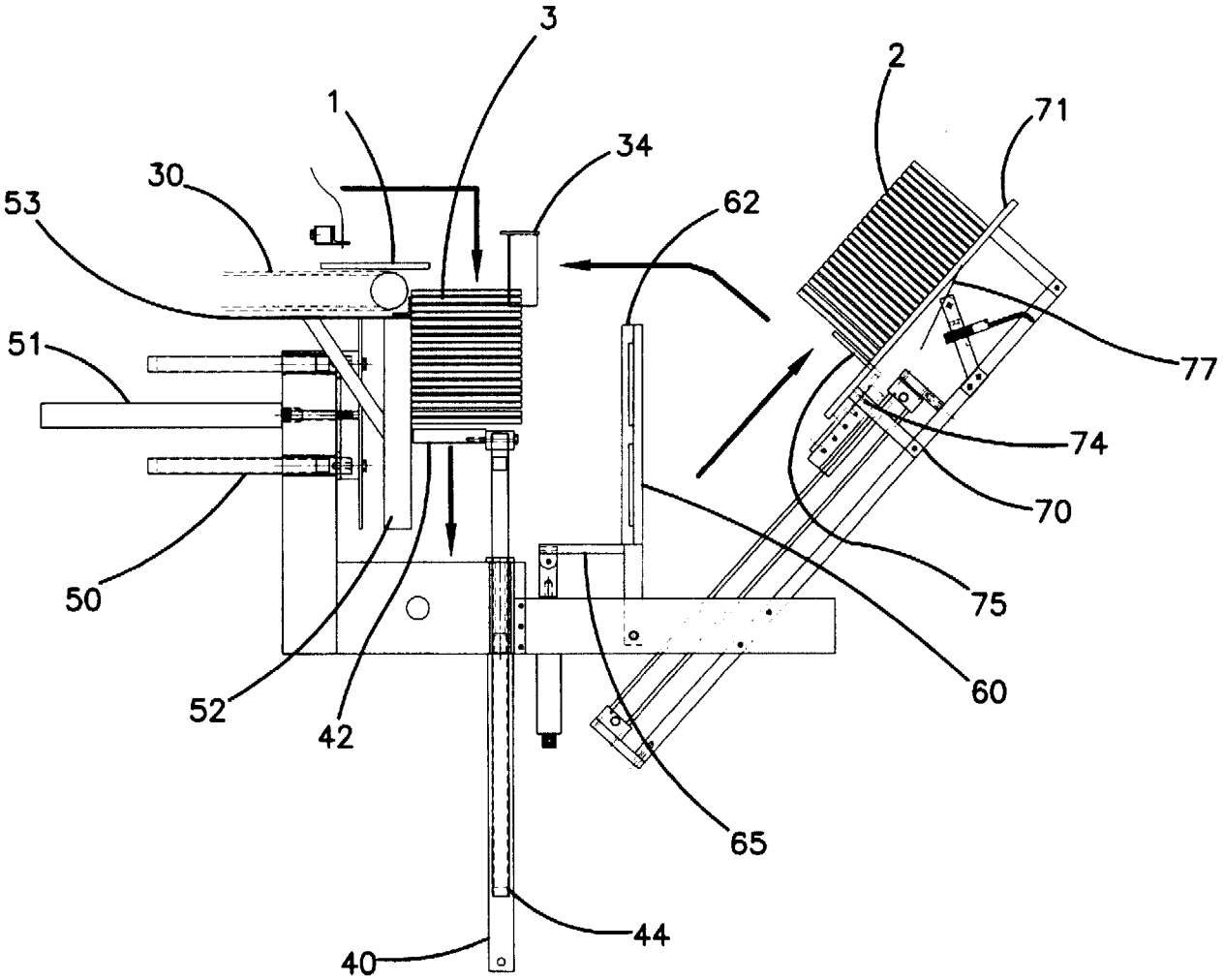

Next, in FIG. 4E, the first stack is transferred off of tilt mechanism 60 using member 75 riding on carriage 74. When the stack is clear of the tilt mechanism, the tilt mechanism may be tilted back to its starting position. In addition, when the stack of articles reaches the top of presentation loader 70, proximity switch 77 is activated to alert the system that a stack is ready to be packaged. In addition, once the stack has been removed from the presentation loader, proximity switch 77 will note this occurrence to permit carriage 74 to return to its starting position.

Concurrently with the operation of tilt mechanism 60 and presentation loader 70, it will be appreciated that second stack 3 is continuing to be built with additional articles 1, and primary stacking member 42 is continuously indexed downward. Upon the completion of stack 3, the stack is transferred and presented in the manner discussed above with relation to FIGS. 4C–4E.

It will be appreciated that the above-described steps occur each cycle, thereby typically resulting in two stacks being operated upon at any given time. Accordingly, in addition to the productivity gains due to the uninterrupted flow of articles into the apparatus, the parallel processing of stacks provides additional productivity gains.

Various modifications may be made to the components used in stacking apparatus 20 consistent with the invention. Moreover, different steps and/or additional functions may be incorporated into the apparatus as desired.

Box Loading Apparatus

Returning to FIG. 1, boxing apparatus 100 generally includes a hand assembly 110 which is manipulated by a series of actuators including a hand extending mechanism 130, a hand tilting mechanism 140 and a lateral positioning mechanism 150 (which, together with box positioning mechanism 170, forms a stack position selecting assembly). Boxes are conveyed through apparatus 100 from a box chute station 270, through box positioning mechanism 170, and through a box transfer station 250. In addition, a web transfer mechanism 280 transfers a supporting web from loaded boxes on the box transfer station to boxes waiting to be loaded at box positioning mechanism 170.

Figure 6:
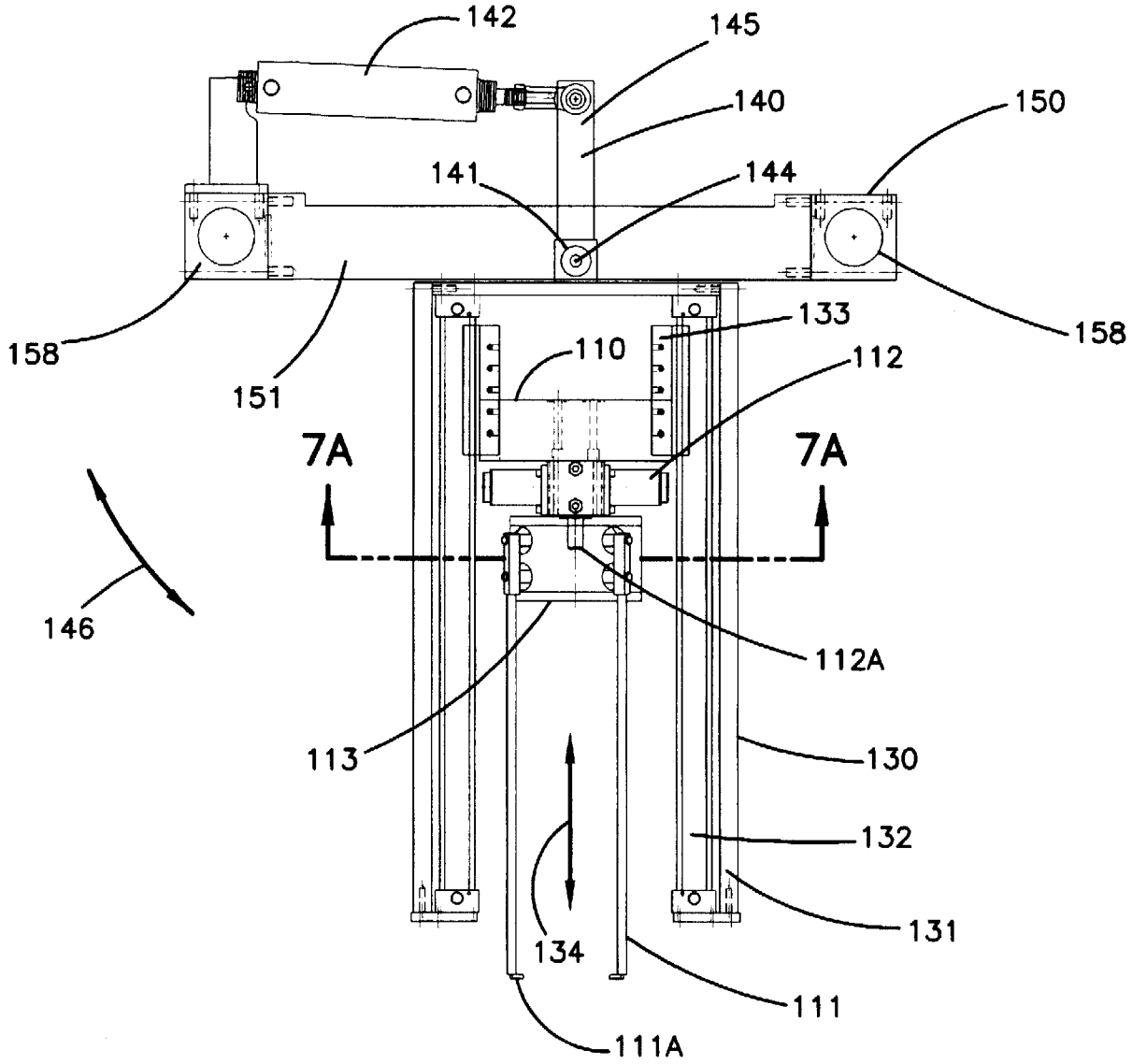
FIG. 6 is an enlarged side elevational view of the primary components of the hand assembly in the boxing apparatus of FIG. 1.

As shown in FIG. 6, hand assembly 110 includes a plurality of fingers 111 (preferably four). Each finger 111 includes a tab **111*a*** which supports a stack of articles when the fingers are in a closed position.

A finger activation mechanism including rotary actuator 112 and linkage 113 which are coupled through a shaft **112*a*. Rotary actuator 112 is preferably a pneumatic actuator, e.g., the PT-196-045-A1 actuator available from Bimba, which rotates shaft 112*a* between first and second rotational positions to open and close fingers 111**.

Figure 7B:
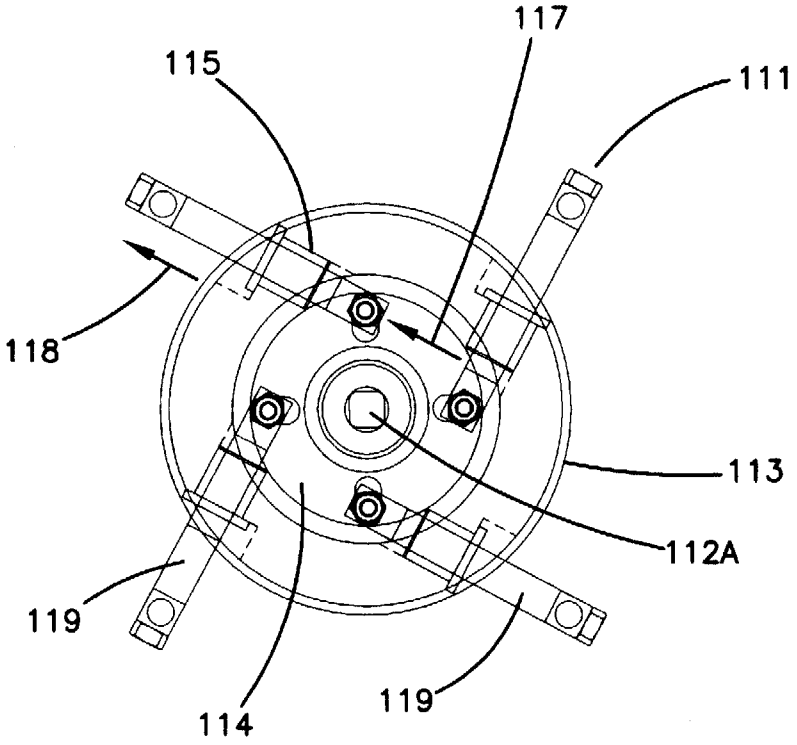
FIGS. 7A and 7B are cross sectional views of the finger activation mechanism in the hand assembly of FIG. 6, taken along line 7A—7A.
Figure 7A:
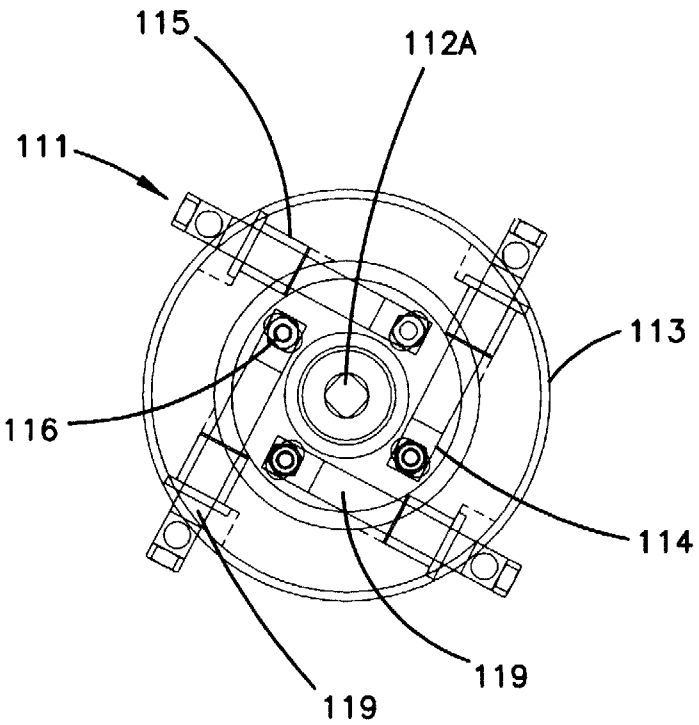

As shown in FIG. 7A, which shows linkage 113 in a closed position, linkage 113 includes a disk member 114 which receives a keyed portion of shaft **112*a* so that member 114 rotates cooperatively with the shaft. Each finger 111 is supported on a pair of transverse coupling members 119 which slide through sleeves 115 and are pivotally coupled to member 114 by a bolt 116**.

To open fingers 111, rotary actuator 112 rotates shaft **112*a* and disk member 114 in the direction of arrow 117 as shown in FIG. 7B. Through this rotation, members 119, and consequently fingers 111, slide radially outward from shaft 112*a* along the direction of arrow 118**.

Different actuation and linkage assemblies may be used to move fingers 111 between open and closed positions, e.g. using individual actuator assemblies for each finger. Other manners of gripping a stack of articles may also be used in the alternative.

Returning to FIG. 6, hand assembly 110 is supported on a hand extending mechanism 130 which includes a pair of hand extending actuators 132 (preferably rodless cylinders) supported on brackets 131. Hand assembly 110 is mounted to sliding brackets 133, such that the actuators move the assembly between extended and retracted positions along the direction of arrow 134.

A hand tilting mechanism 140 tilts hand assembly 110 between a first, substantially vertical position (as shown in FIG. 6) to a second, inclined position which is proximate to and substantially coaxial with presentation loader mechanism 70 (generally in the direction of arrow 146). A bracket 144, coupled to brackets 131, is pivotally mounted through bolt 141 to a carriage 151. A hand tilting actuator 142 (preferably a pneumatic cylinder) couples an arm 145, mounted to bracket 144, with a bracket fixedly mounted to carriage 151. Through actuation of actuator 142, hand assembly 110 is pivoted about bolt 141 between the first and second positions.

Carriage 151 is supported by and slidable along a pair of shafts 158. A pneumatic cylinder 152 (see FIG. 2B) in lateral positioning mechanism 150 positions carriage 151, and consequently, hand assembly 110, at various positions in the direction along the axis of bolt 141. As is also shown in FIG. 2B, a position sensor 154 (preferably a string potentiometer) extends between a fixed point on frame 104 to carriage 151 to provide feedback as to the lateral position of the carriage.

In general, lateral positioning mechanism 150 is capable of positioning hand assembly 110 proximate the presentation loaders of stacking apparatus 20 or stacking apparatus 82. Mechanism 150 is also capable of positioning hand assembly 110 proximate one of a plurality of rows in a box. Precise placement of hand assembly 110 using lateral positioning mechanism 150 is discussed in greater detail below with respect to FIGS. 11 and 12.

Returning to FIGS. 1 and 2B, boxes are supplied by a box chute station 270 which is preferably in the form of a chute or slide for providing gravity feed of boxes. A pair of pneumatic actuators, first chute actuator 272 and second chute actuator 274, supply boxes to apparatus 100 one box at a time. In a closed or extended position, actuator 272 is configured to compress the side of a box against the side of chute 270 to hold the box in place. In a closed or extended position, actuator 274 is configured to project across the chute to support the leading end of a box.

Boxes drop from chute 270 onto a platform 291 of a box alignment station 290. At this station, the box is aligned to a precise position, loaded with a web 288 by a web transfer mechanism 280 (discussed below), and transferred to box positioning mechanism 170. A load actuator (preferably a push cylinder) 295 pushes the box from the alignment station to platform 171 of box positioning mechanism 170. Prior to transferring the box, however, the box is aligned laterally by pushing the box against an outside wall of the apparatus using a first alignment actuator 293, which is preferably a thumper cylinder. In addition, the box is aligned longitudinally by a second alignment actuator 294 on push cylinder 295.

A box positioning mechanism 170, including a support platform 171 movable by a pneumatic cylinder 172, positions a box in a longitudinal direction (transverse to the movement of hand assembly 110 by lateral positioning mechanism 150) to select one of a plurality of columns in a box for placement by hand assembly 110. A position sensor 174 (preferably a string potentiometer) extends between a fixed point on frame 104 to platform 171 to provide feedback as to the longitudinal position of the platform. In addition, a box eject actuator 175 (preferably a pneumatic cylinder) is mounted on platform 171 to transfer a loaded box off of the platform and over to a box transfer station 250.

Figure 8:
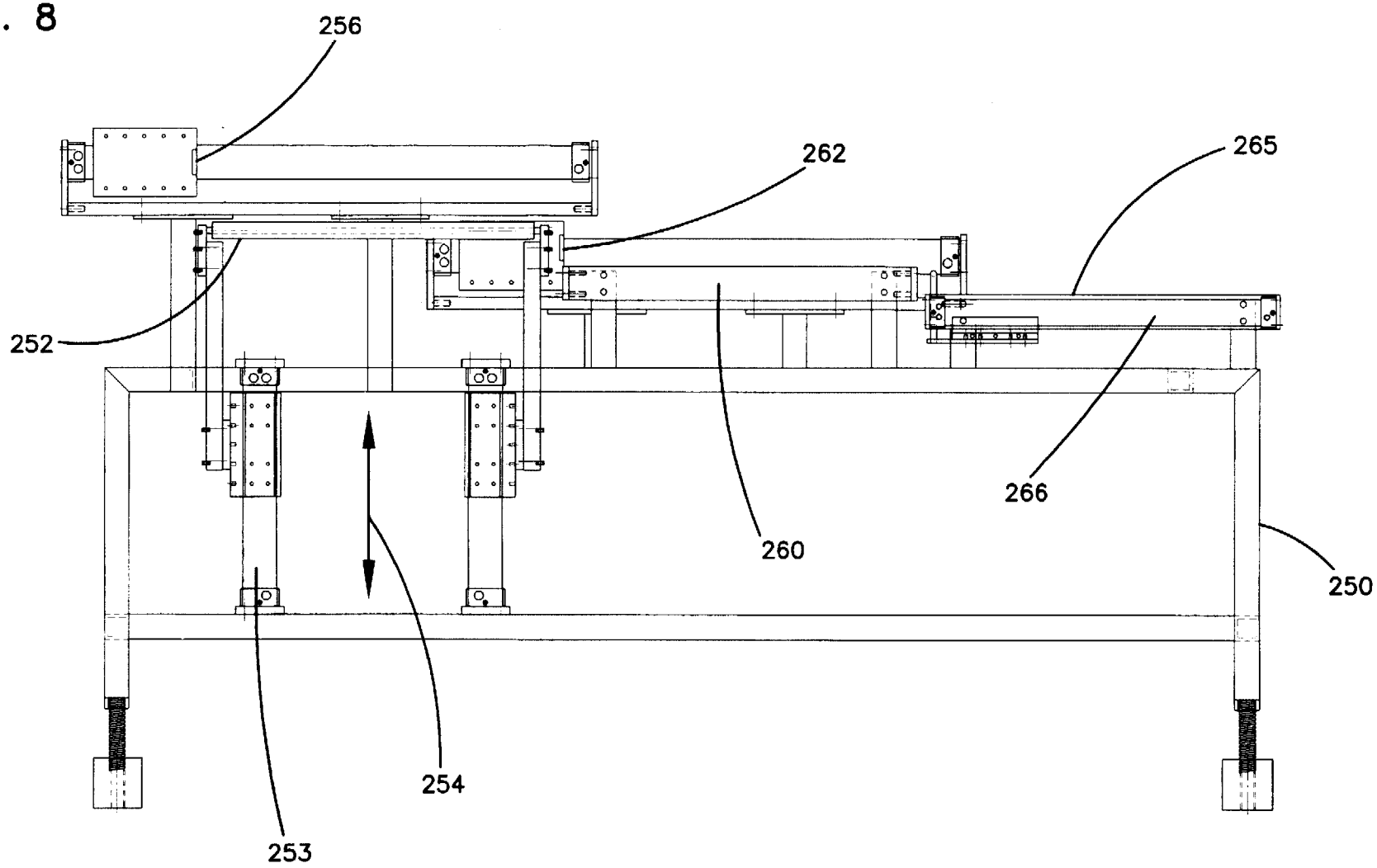
FIG. 8 is a side elevational view of the box transfer station in the boxing apparatus of FIG. 1.

As shown in FIGS. 2B and 8, box transfer station 250 includes a first platform 252 which may be raised and lowered (i.e., in the direction of arrow 254) by pneumatic platform actuators 253. Platform 252 is preferably in a lowered position when a box is ejected from platform 171 by box eject actuator 175. Once a box is received, first platform 252 is raised to the position shown in FIG. 8. A first transfer actuator 256 then transfers the box from first platform 252 to a second platform 260. Second platform 260 includes a second transfer actuator 262 which transfers the box to a third platform 265. A third transfer actuator 266 then ejects the box out of the apparatus, typically onto a separate conveyor running transverse to apparatus 100 (not shown).

Returning to FIGS. 1 and 2B, a web transfer mechanism 280 transfers a web 288 between loaded and unloaded boxes for use in the boxes while stacks of articles are transferred into the boxes by hand assembly 110. Web 288 is preferably an arrangement of stainless steel dividers which, when placed in a box, form a desired number of compartments for inserting stacks of articles (preferably to form a 2 row by 4 column array of stacks within a box). To accommodate different size articles or different size boxes, multiple web designs may be used with apparatus 100, thereby making the apparatus adaptable to different product and box configurations.

For some stackable articles, the use of a web may not be required. However, for many articles, e.g., hamburger patties, it has been found that the web substantially facilitates handling in apparatus 100 by preventing stacks placed in partially loaded boxes from falling over or otherwise inhibiting the loading process.

Web 288 is preferably removed from a box on second platform 260 (which operates as an unloading station) and placed in an empty box in box alignment station 290 (which operates as a loading station). In addition, it may be preferable to rotate two webs 288 through the apparatus so that a web from a full box may be removed and placed in another box while one box is being loaded by hand assembly 110.

Web transfer mechanism 280 includes a web grip actuator 286 supported on a web lift actuator 284. Actuator 284 is mounted to a bracket 285 supported on a web transport actuator 282, which is in turn supported on frame 102. Actuators 282 and 284 are preferably pneumatic rodless cylinders which work in cooperation to position web grip actuator 286 over a full box on second platform 260, grab web 288, raise the web and position it over an empty box, drop the web into the box, and return to grab the next web on second platform 260.

Figure 10:
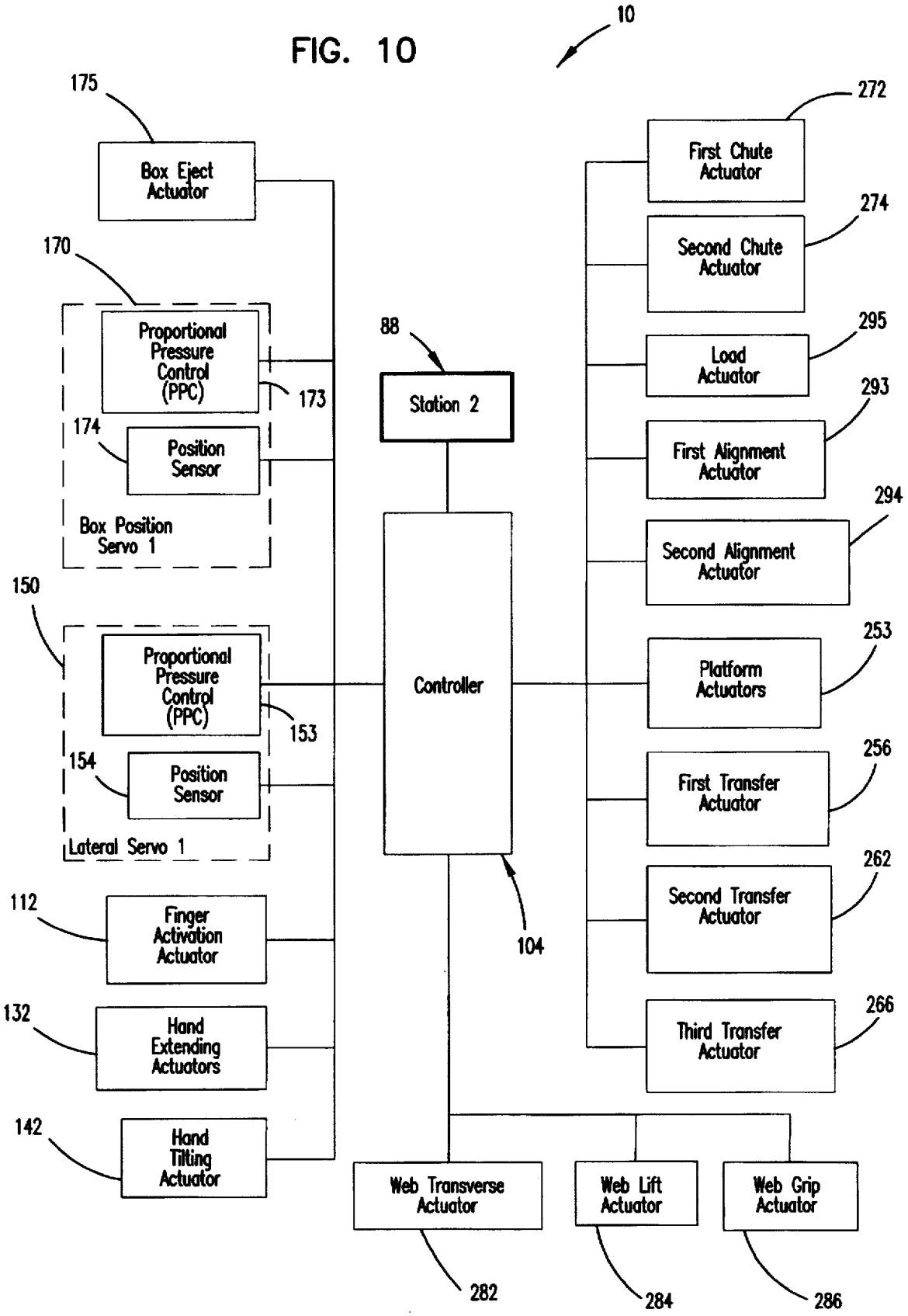
FIG. 10 is a functional block diagram of the control system of the boxing apparatus in FIG. 1.

FIG. 10 is a block diagram of the primary operational components of the boxing apparatus 100 of packaging system 10, including a controller 104 which coordinates the operation of the various boxing apparatus mechanisms. Controller 104 is preferably a programmable controller manufactured by General Electric, although other programmable controllers may be used in the alternative. Controller 104 preferably also controls boxing apparatus 88. As different numbers of stations, conveyors, etc. may be provided in packaging system 10, it will be appreciated that different controller configurations may be used in the alternative. Moreover, multiple controllers may be used to handle different aspects of the operation of the system.

Boxing apparatus 100 is connected to controller 104 through connections to the various actuators, including finger activation, hand extending, and hand tilting actuators 112, 132 and 142; box eject actuator 175; first and second chute actuators 272 and 274; load actuator 295; first and second alignment actuators 293 and 294; platform actuators 253; first, second and third transfer actuators 256, 262 and 266; and web transport, web lift and web grip actuators 282, 284 and 286. The control over these actuators, which are preferably pneumatic cylinders, is generally through their control valves, which may vary depending upon the type of cylinder used. In addition, limit switches may also be provided to determine when a cylinder has moved between its two positions. Moreover, the type of controller required for controlling other types of actuators, such as hydraulic and/or electromechanical actuators, will also vary. The control of these types of devices is generally understood in the art and is therefore not discussed in further detail herein.

Two additional functions are handled by controller 104 to provide control over the stacking position selecting assembly such that stacks are placed in different locations. As discussed above, the position of each stack is controlled by a pair of mechanisms. First, a lateral positioning mechanism 150 (lateral servo) positions the hand assembly laterally (i.e., transverse to the general flow of material through system 10, and designated the "x" direction). Second, a box positioning mechanism 170 (box position servo) positions a box longitudinally (i.e., along the general flow of material, and designated the "y" direction). Each mechanism 150, 170 includes a proportional pressure control (PPC) valve 153, 173 for controlling movement of the mechanism, and a position sensor 154, 174 on each mechanism provides positional data as feedback to controller 104.

Mechanisms 150, 170 differ from the other actuators in that they may be discretely positioned at various intermediate points along the length of the cylinders. The other actuators, e.g., actuators 112, 132, 142, 175, 272, 274, 253, 256, 262, 266, 282, 284, 286, 293, 294, 295, etc., preferably have only two positions at opposing ends of the cylinders. However, any of the above cylinders or actuators may operate in either manner if desired or necessary.

Operation of boxing apparatus 100 is illustrated in FIGS. 9A–9F. Two primary operations are performed by the apparatus in parallel. The first is the transfer of stacks of articles into boxes. The second is the movement of boxes through the apparatus.

Figure 9A:
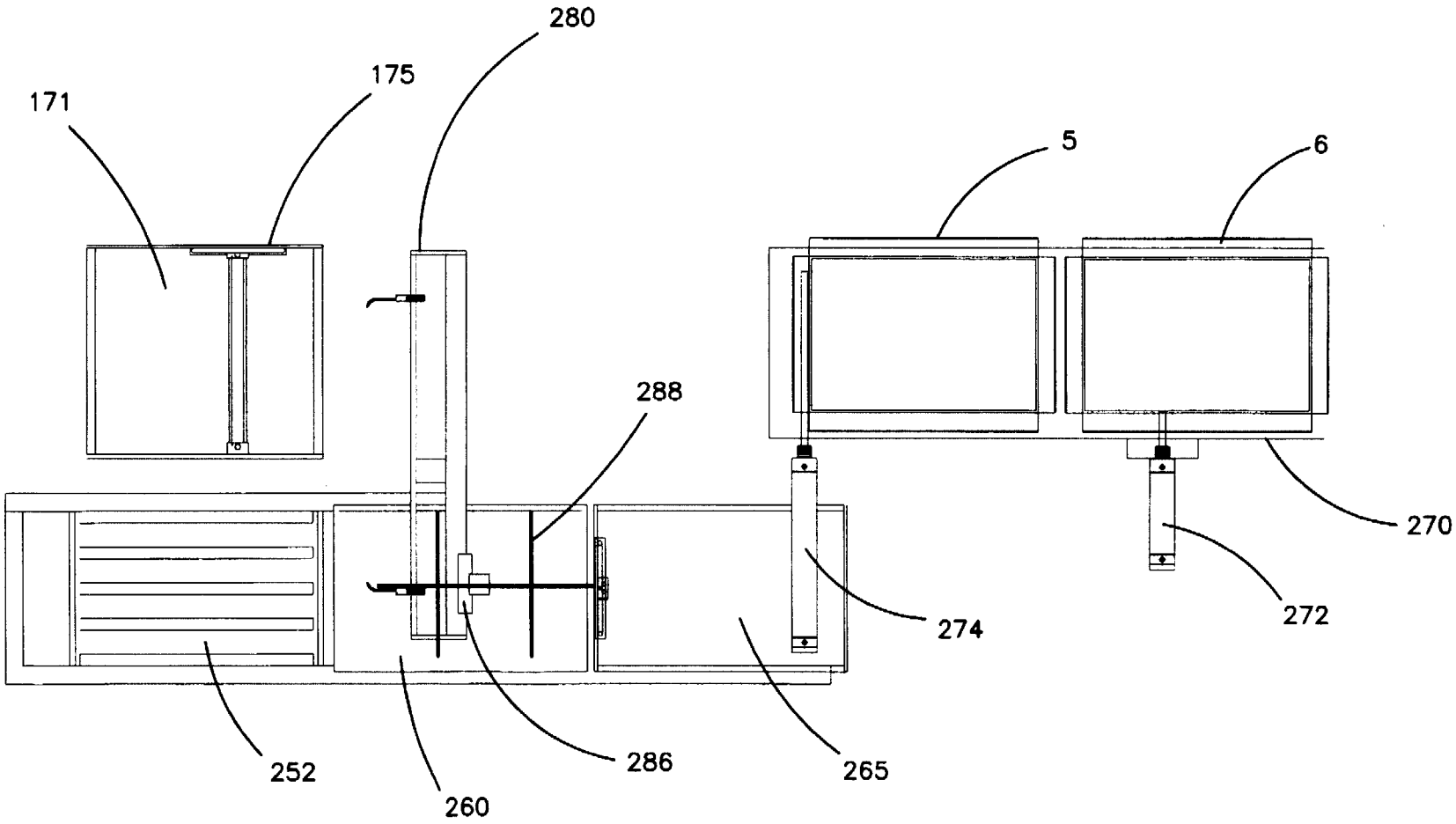
FIGS. 9A–9F are top plan views of the boxing apparatus of FIG. 1 showing various stages of moving boxes through the boxing apparatus and transferring stacks of articles into the boxes.
Figure 9B:
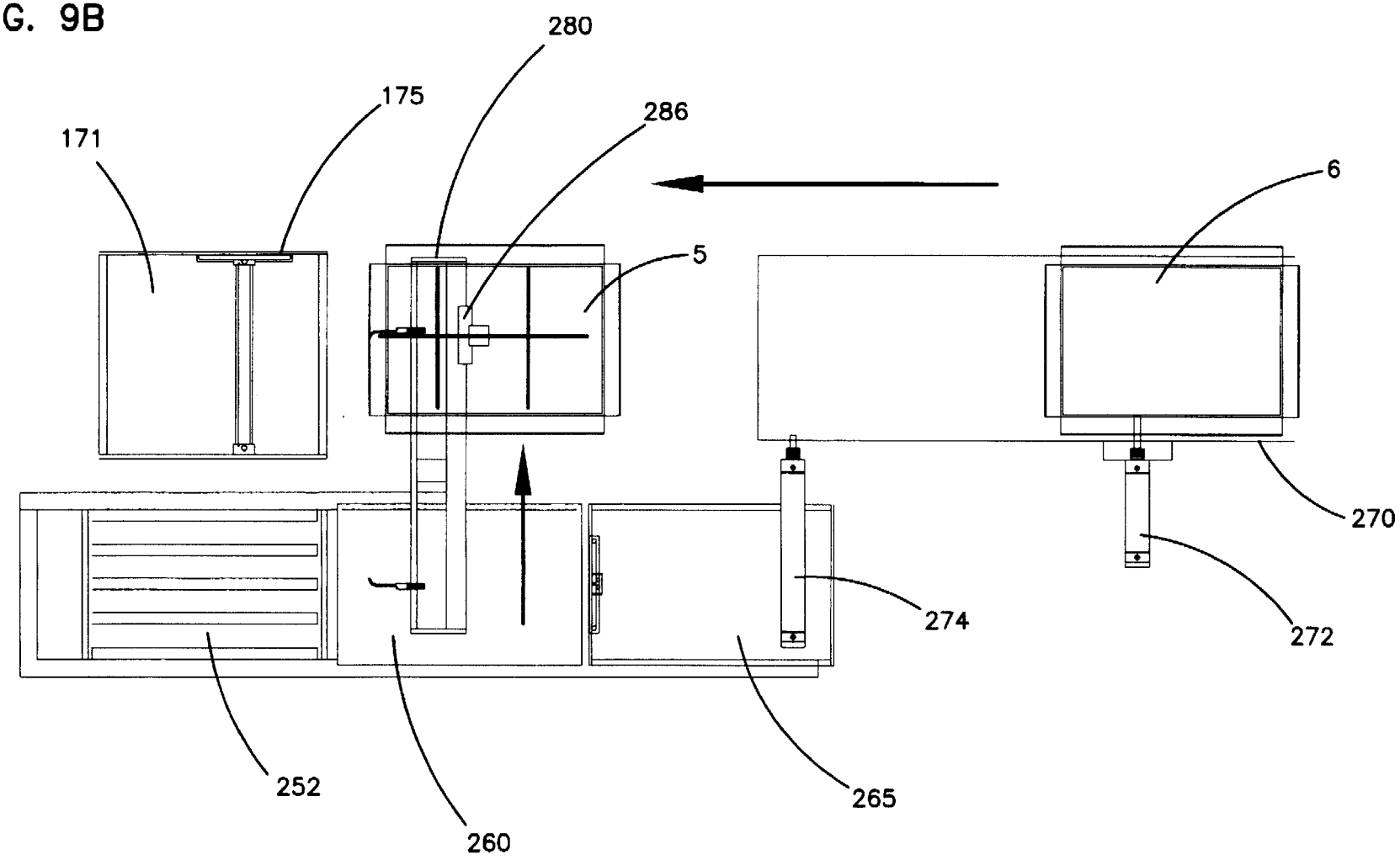

As shown in FIG. 9A, a supply of boxes (including first and second boxes 5 and 6) are initially disposed in chute 270. Second chute actuator 274 is initially closed or extended to retain box within chute 270. In addition, first chute actuator 272 is preferably closed or extended to compress box 6 against the side of chute 270 and thereby secure the box in the chute. Next, as shown in FIG. 9B, the movement of boxes through apparatus 100 begins with dropping first box 5 into the apparatus by opening second chute actuator 274.

When box 5 drops from chute 270, it is received on a platform 291 of box alignment station 290, where the box is aligned by actuators 293 and 294. Then, a web 288 is transferred to box 5 by controlling actuators 282, 284, and 286 to grip the web, raise it, transport it over to the empty box, drop it and release it within the box.

Figure 9C:
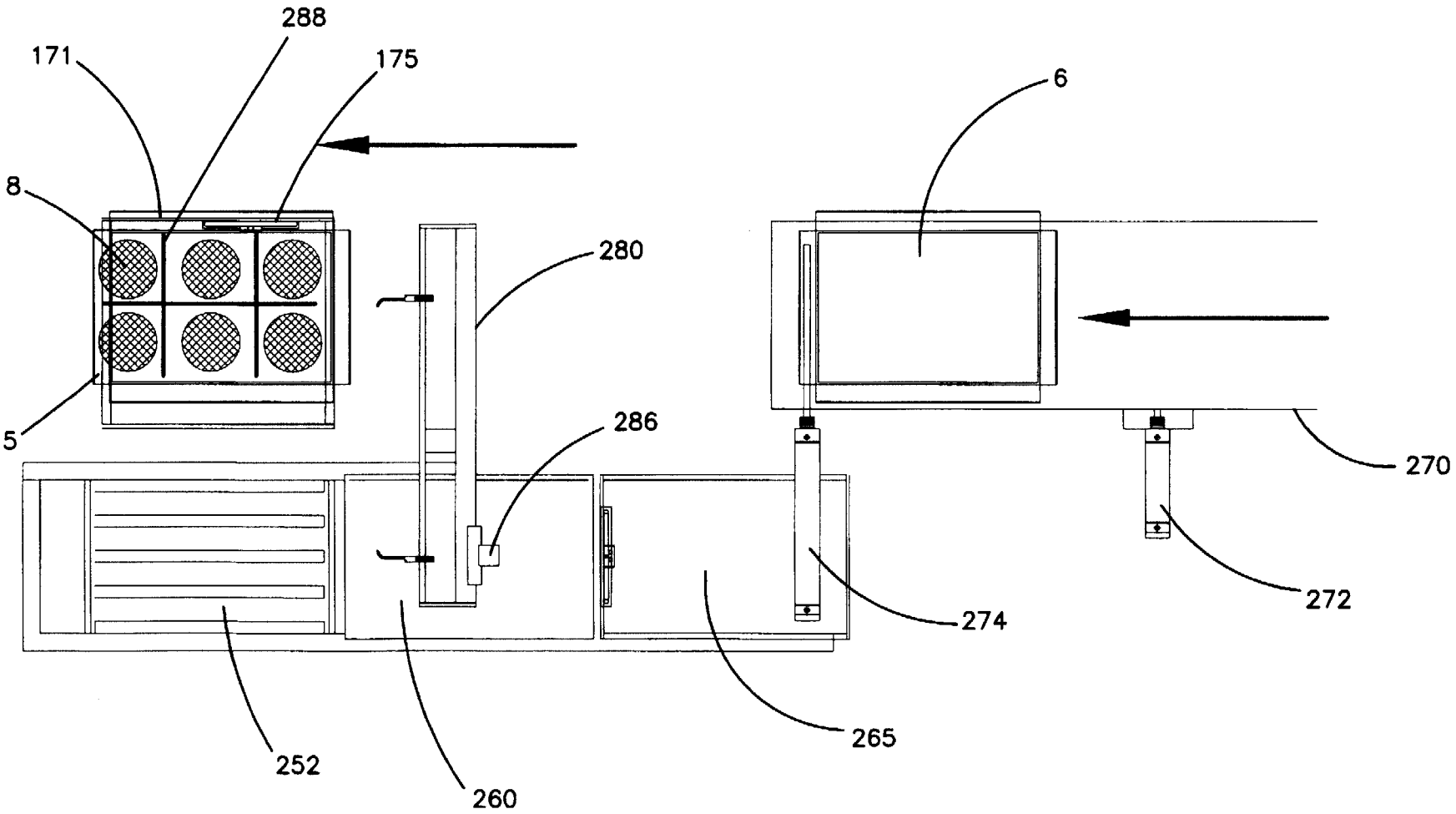

Next, as shown in FIG. 9C, load actuator 295 pushes the box onto platform 171 to be loaded with stacks of articles by hand assembly 110. Also, second chute actuator 274 is closed. In addition, a second box 6 is advanced in chute 270 by opening first chute actuator 272, where it is retained within the chute by actuator 274.

Box 5 is loaded by transferring stacks of articles 8 from presentation loader 70 of apparatus 10 (and from the presentation loader of apparatus 82) to the box by controlling actuators 112, 132, 142 as well as mechanisms 150 and 170. Movement of hand assembly 110 to place the individual stacks 8 into box 5 is not shown separately in FIG. 9C.

However, as an example of the loading operation, when a stack is ready at presentation loader 70, proximity switch 77 is triggered (see FIG. 3), and in response, hand assembly 110 is opened by actuator 112, moved to an unextended position by actuator 132 and tilted to an inclined position by actuator 142. In addition, lateral positioning mechanism 150 is operated to position the hand assembly for receiving articles presented by presentation loader 70.

Next, the hand assembly is extended by actuator 132 with fingers 111 opened such that the fingers extend along the presentation loader to surround a stack of articles. Actuator 112 closes the fingers such that the stack is supported by tabs 111*a* on the fingers, and the hand assembly is moved to an unextended position by actuator 132, with the stack of articles supported by the fingers.

The hand assembly is next tilted by actuator 142 to a vertical position. Lateral positioning mechanism 150 and box positioning mechanism 170 are operated (as discussed in detail below) to select one of the positions in box 5 to place the stack of articles. Hand assembly 110 is extended by actuator 132 to locate the stack of articles in the selected position in the box, and fingers 111 are opened by actuator 112 to drop the stack within the box. The process then repeats when another ready stack is detected by controller 104.

It should be appreciated that apparatus 10 and apparatus 82 substantially continuously produce stacks of articles at their respective presentation loaders. Accordingly, hand assembly 110 is typically continuously operated to alternately place stacks from each apparatus 10 and 82. It should also be appreciated that each actuator 112, 132 and 142 and mechanism 150 and 170 may be controlled simultaneously to increase the movement speed of hand assembly 110, in a manner generally known in the art. Loading of boxes may occur in any order, preferably by starting at the top row of a first column (i.e., the top left position in FIG. 9C), then loading each position in the column from top to bottom, indexing platform 171 to the left to select the next column, and loading the next column, etc.

Figure 9D:
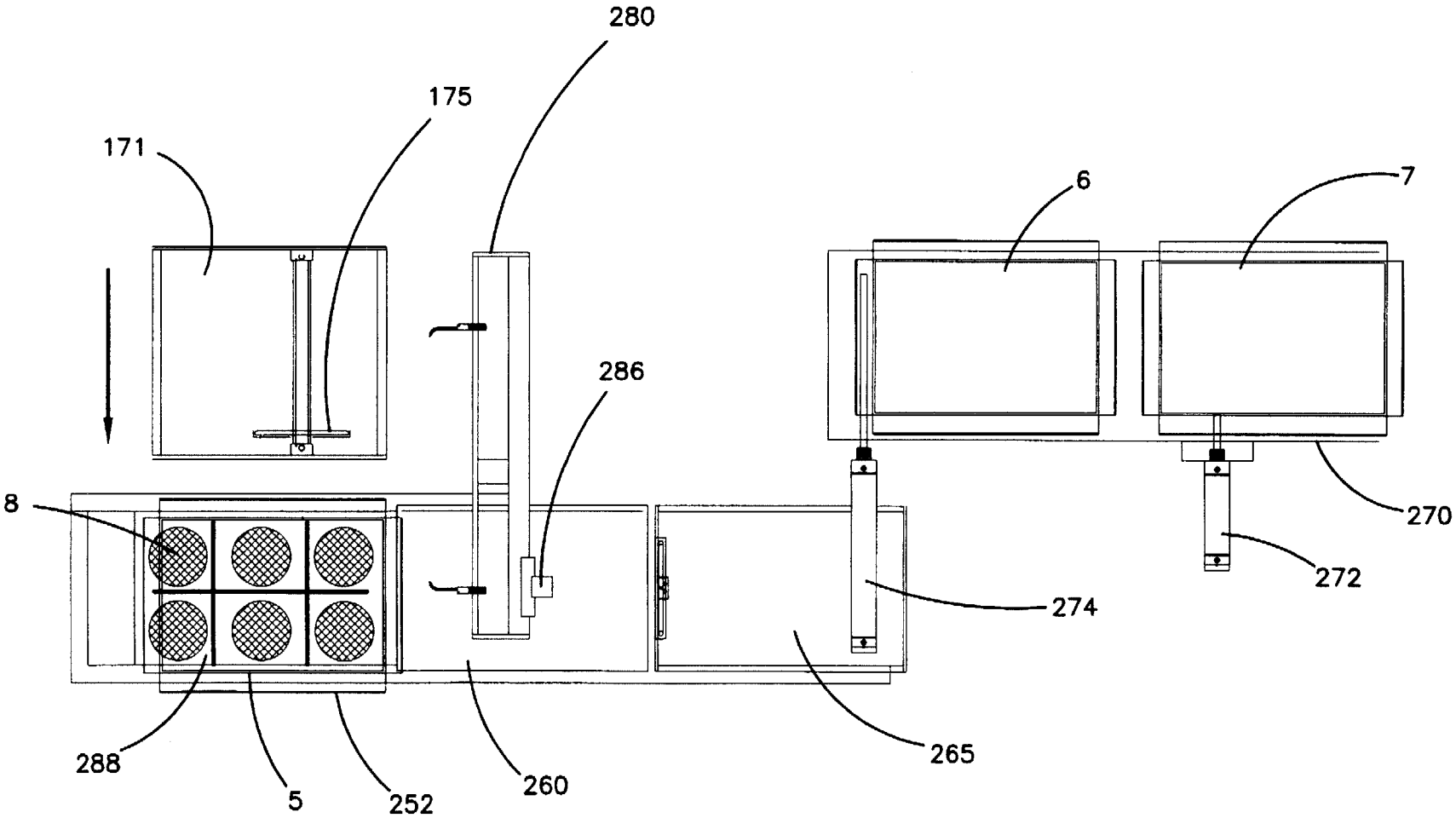

Next, as shown in FIG. 9D, once the box has been filled with stacks 8, it is ejected by box eject actuator 175 onto first platform 252. In addition, by this time a third box 7 has been gravity fed through chute 270 to a position behind second box 6. First chute actuator 272 is then closed to secure third box 6 within the chute.

Figure 9E:
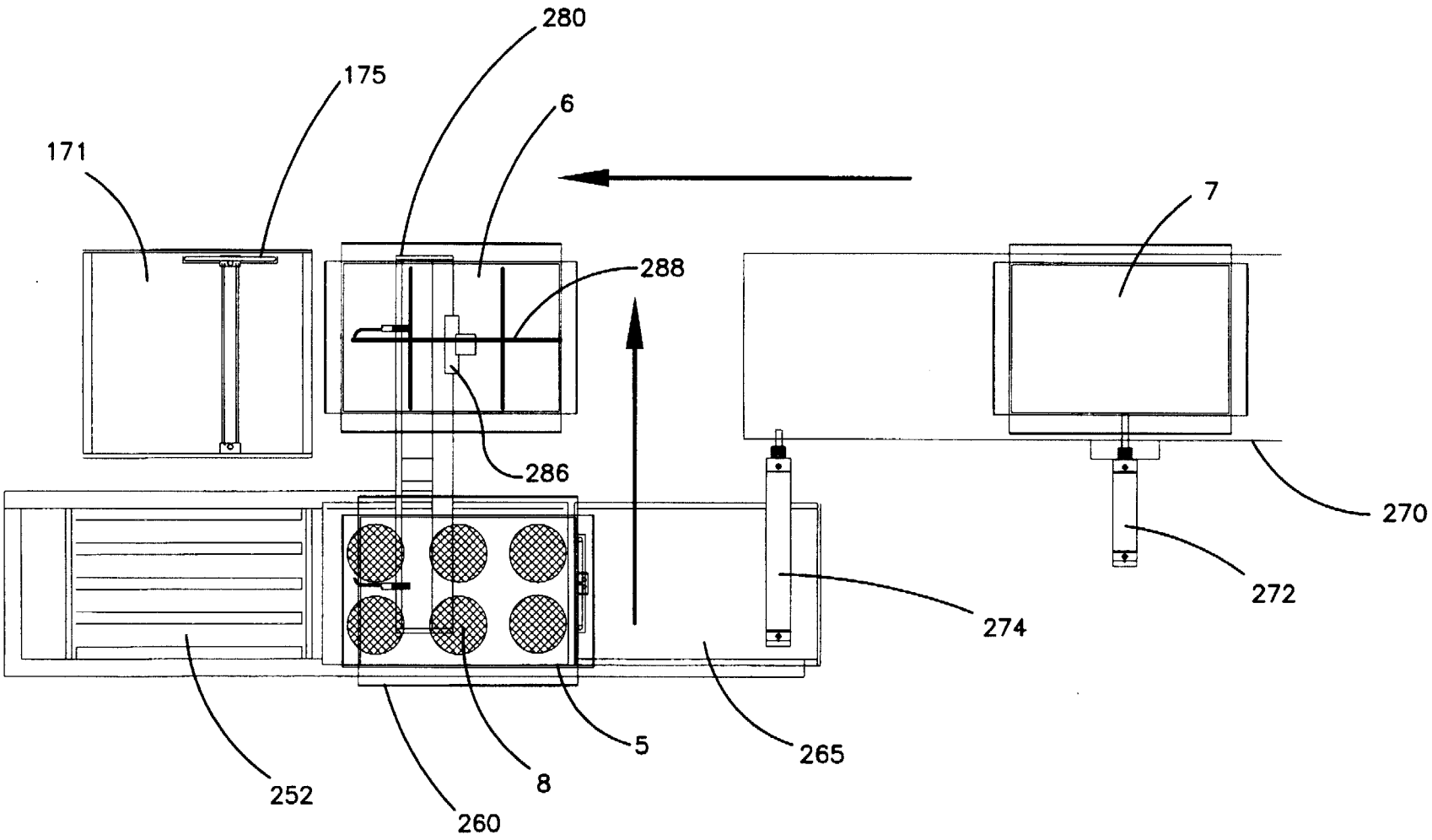

Next, as shown in FIG. 9E, box 5 is raised by platform actuators 253 and the box is transferred to second platform 260 by first transfer actuator 256. In addition, box 6 is released from chute 270 by actuator 274 and is aligned on platform 291 in the manner discussed above. In addition, web 288 is removed from the loaded box 5 and placed in the empty box 6 by web transfer mechanism 280 in the manner discussed above.

Figure 9F:
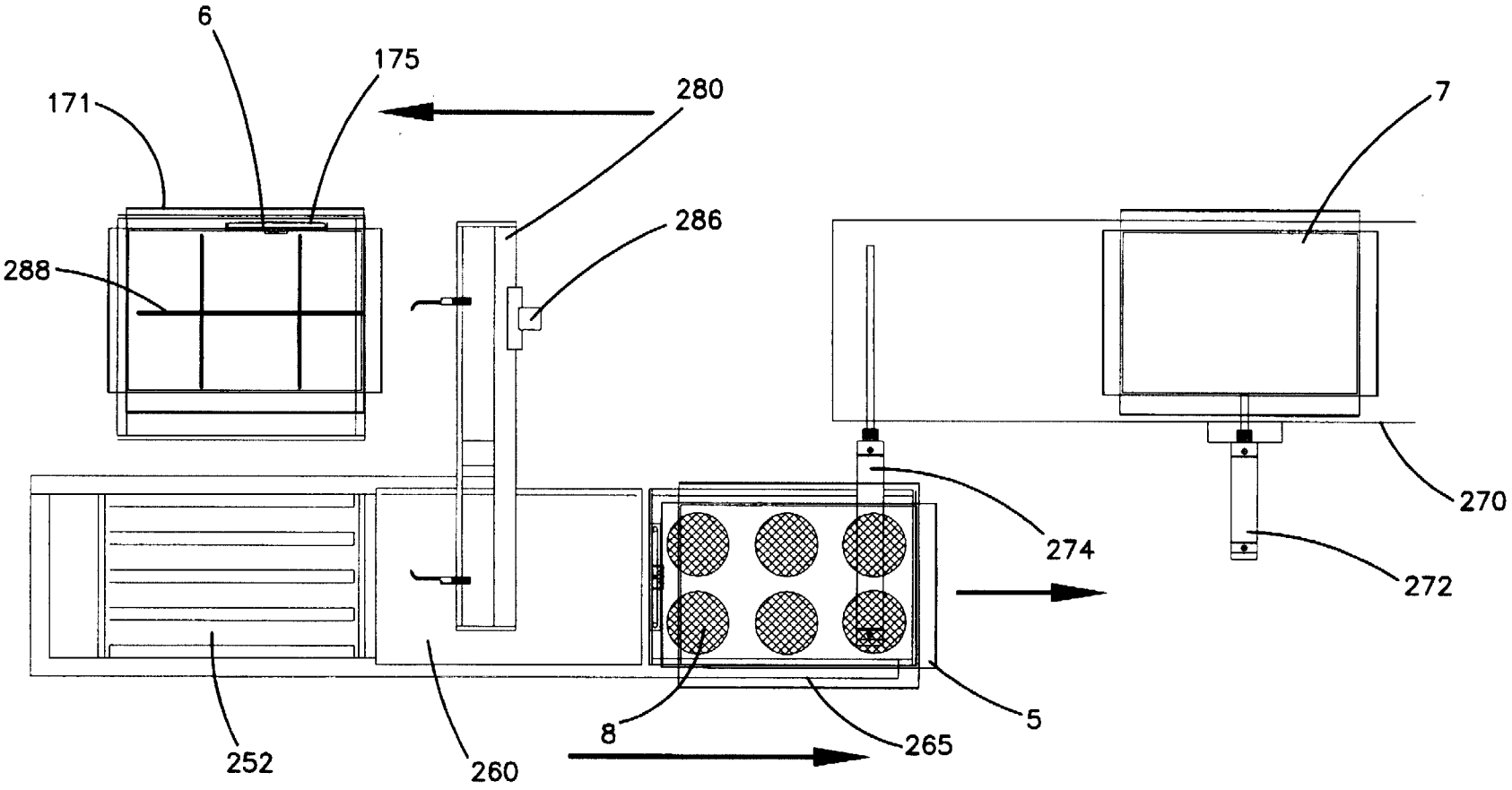

Next, as shown in FIG. 9F, box 5 is transferred to third platform 265 by second platform actuator 262, where it is subsequently transferred off of platform 265 by third transfer actuator 266 and onto a conveyor (not shown). Also, at this time box 6 is transferred to platform 171 for loading by hand assembly 110. Loading of all subsequent boxes, including boxes 6 and 7, proceeds in the same manner for box 5.

Various modifications may be made to the manner in which boxes and products are transferred through apparatus 100. For example, as discussed above, a pair of webs may be rotated through the apparatus, such that when a web is removed from a loaded box on platform 260, it is placed in the second empty box upstream in the apparatus. This permits the web transfer to occur while another box (located between the two boxes involved in the web transfer) is being loaded with articles on platform 171, thereby reducing the processing cycle for each box. Other modifications will be apparent to one skilled in the art.

Figure 11:
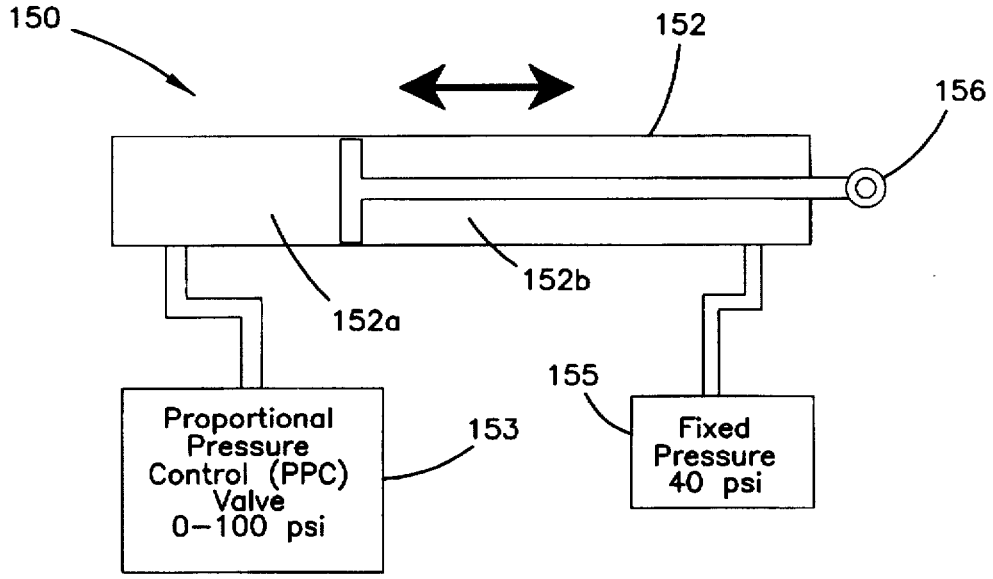
FIG. 11 is a functional diagram of the lateral positioning mechanism in the boxing apparatus of FIG. 1.

As discussed above, lateral and box positioning mechanisms 150 and 170 require additional control to provide positional control in apparatus 100. FIG. 11 illustrates the control mechanisms for lateral positioning mechanism 150 in greater detail. The control mechanisms for box positioning mechanism 170 operate in a similar manner. As shown in this Fig., cylinder 152 of mechanism 150 includes a piston 156 which forms two chambers 152*a* and 152*b*, each of which is coupled to a pressure source. A greater pressure in one of the two chambers induces movement of the piston toward the other of the two chambers until the pressure in both chambers balance.

Boxing apparatus 100 incorporates a proportional pressure control (PPC) valve 153 as a first pressure source to supply pressure to chamber 152*b*. A fixed pressure source 155 operates as the second pressure source for supplying chamber 152*a*.

In the preferred embodiments, PPC valve 153 is a 5AAAA-AGAB-BBA-1BA valve manufactured by MAC, which is capable of providing a pressure of 0 to 100 psi when connected to a pressure source over 100 psi (not shown). Fixed pressure source 155 preferably provides 40 psi of pressure in a manner known in the art. Thus, by raising or lowering the pressure supplied by PPC valve 153 to above or below 40 psi by an amount which exceeds the static friction of the cylinder, movement of the piston may be induced in both directions by the valve.

Various modifications may be made to the design of mechanisms 150 and 170. For example, movement of the cylinders may be facilitated or deterred through the use of exhaust ports or springs. In addition, PPC valves may be used for both chambers of the cylinder. Other modifications will be apparent to one skilled in the art.

Control of mechanisms 150, 170 by controller 104 is somewhat different than for the other cylinders and actuators in system 10. The other devices are primarily two position devices, the control of which with controller 104 is conventional in nature. To accurately position mechanisms 150 and 170, however, controller 104 must be programmed with specific routines for handling these mechanisms.

Figure 12:
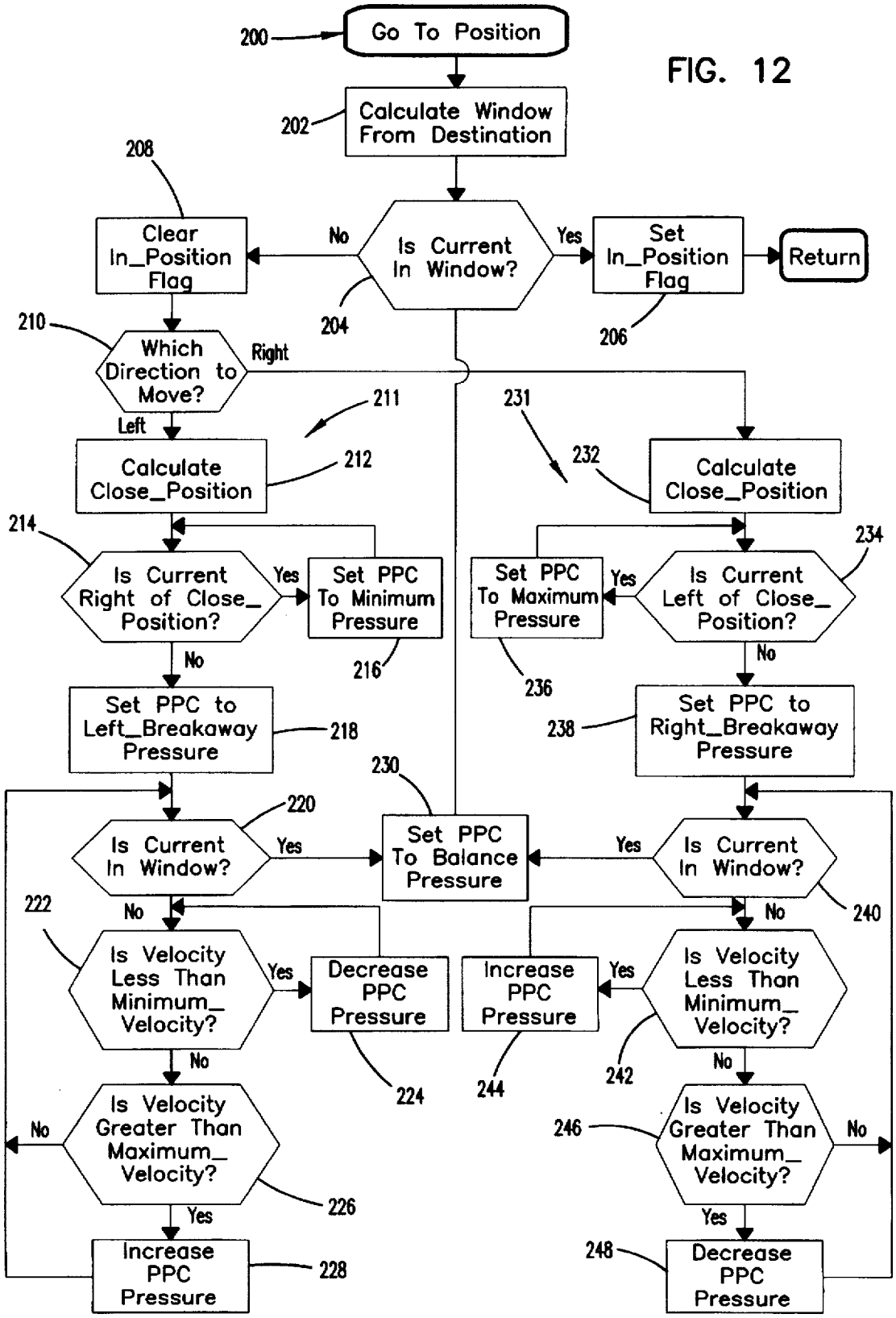
FIG. 12 is a flowchart illustrating the program flow of a GO_TO_POSITION routine for controlling the lateral positioning mechanism of FIG. 11.

FIG. 12 illustrates a GO_TO_POSITION routine 200 which may be executed by controller 104 to position mechanism 150 at a desired point. The routine for mechanism 170 operates in a similar manner. Both routines are executed in controller 104 in response to a request by the controller to move the respective mechanism to a particular position. Generally, each routine receives a destination, or desired point, as an input, and each returns an In_Position flag whenever their respective mechanism is at its destination point. In addition, each routine relies on both the position and the velocity of its respective mechanism as feedback to control the positioning of the mechanism, as discussed below. The implementation of such routines into the control logic of controller 104 is generally understood, and need not be discussed in greater detail here. For example, it will be appreciated that the routines may execute sequentially, concurrently (e.g., via different processing threads in a multiprocessing system), via interrupts, etc.

Routine 200 first executes block 202 to calculate a window or range, including left and right limit points offset from the destination, or desired, point which is supplied as an input to the routine. The window defines the acceptable tolerance at which mechanism 150 is considered in position. The window should be small enough to provide acceptable positioning accuracy, yet should be large enough that the controller does not consistently attempt to reposition mechanism 150 when it is at its desired position.

Routine 200 then executes block 204 to determine whether the current position is within the window. The current position is preferably determined by reading position sensor 154 and applying any scaling as necessary.

If the current position is in the window, then mechanism 150 does not need to be repositioned. Thus, in block 206, an In_Position flag is set to indicate that the mechanism is in position. Then, routine 200 terminates and returns control to the main routine.

If the current position is outside of the window, block 208 clears the In_Position flag, and block 210 determines whether a left or right movement of mechanism 150 is required to reach the desired destination (e.g., by subtracting the current position from the desired position and checking the sign—negative representing a left movement and positive representing a right movement). If a left movement is required, the blocks in branch 211 execute, and if a right movement is required, the blocks in branch 231 execute.

For a left movement, block 212 first calculates a close position, which is a position between the current and destination positions at which movement of the piston must be decreased to provide accurate positioning, as described below. This variable is preferably determined by adding a deceleration constant to the destination position. The constant is preferably determined empirically as different systems may have different deceleration constants.

Next, block 214 checks if the current position is right (greater than) the close position. If so, block 216 is executed to set PPC valve 153 to its minimum pressure, thereby inducing movement of the piston at its maximum rate, then returns to block 214.

Once the current position is equal to or left of the close position, block 218 increases the pressure of PPC valve 153 to a left breakaway pressure, which is the maximum pressure, empirically determined, which is lower than the pressure required to induce movement of the mechanism to the left. This pressure may be several psi below the constant pressure supplied by source 155 (about 40 psi in the preferred embodiments) due to the static friction inherent in the cylinder. The designation "breakaway" is due to the relatively lower dynamic friction in cylinders, since a pressure overcoming the static friction, if maintained, causes the piston to accelerate toward its end position.

Next, in block 220, the current position is again compared to the window to determine whether the destination has been reached. If this position has not yet been obtained, a loop is executed in blocks 222–228 to monitor and control the velocity of the mechanism piston as it nears the destination position. The velocity may be obtained by checking the current position at fixed intervals (e.g., every 20 ms) and taking the difference of the positions at two intervals. Additional scaling to desired units may be performed, although it is not required.

In block 222, the velocity is compared with a minimum velocity constant. If the velocity is below the minimum velocity, block 224 decreases the PPC valve pressure output to increase the velocity of the piston, then control returns to block 222. If the velocity is not below the minimum velocity, block 226 checks if the velocity is above a maximum velocity, and if so, the PPC valve pressure output is increased to slow down the piston. In either even control returns to block 220 to check if the destination position has been reached.

When the destination position is reached, control passes from block 220 to block 230 to set the PPC valve output pressure to a balance pressure, which represents a pressure which stops and maintains the piston in a fixed position. The balance pressure is theoretically equal to the fixed pressure supplied by source 155; however, due to loading of the piston and different areas of the chambers in the cylinder, it has been found in the preferred embodiments that the balance pressure is about 45 psi.

Once the piston is stopped, control passes to block 204, which, as long as the piston is still in the window, then passes control to block 206 to set the In_Position flag and to terminate the routine.

Operation of a right movement of mechanism 150 in branch 231 is similar to branch 211. Specifically, in block 232, a close position is determined, preferably by subtracting the same deceleration constant from the destination position. In block 234, the current position is compared to the close position. If the current position is left of the close position, the PPC valve is set at its maximum pressure output (100 psi in the preferred embodiments) in block 236 to move the piston at full velocity to the right. Once the current position is within the "close" range, block 238 decreases the PPC valve output to a right breakaway pressure, which is the minimum pressure, empirically determined, which is higher than the pressure required to induce movement of the mechanism to the right.

After the pressure is reduced, block 240 checks if the current position is within the window, and if it is not, the loop of blocks 242, 244, 246 and 248 maintains the velocity of the piston of mechanism 150 between the minimum and maximum velocities discussed above until block 240 determines that the current position is within the window. When this occurs, block 230 sets the PPC valve output to the balance pressure, block 204 determines whether the current position is still in the window, and if so, block 206 sets the In_Position flag before terminating routine 200 and returning control to the main routines of controller 104.

Thus, routine 200 provides two ranges of motion of mechanism 150. First, coarse positioning is performed at the full velocity of the piston when the piston is outside of the close position. This is generally performed in the loop of blocks 214–216 for left movement and the loop of blocks 234–236 for right movement. Second, fine positioning is performed at a controlled and reduced velocity (between minimum and maximum limits) when the piston is within the close position. This is generally performed in the loop of blocks 220–228 for left movement and the loop of blocks 240–248 for right movement.

The minimum and maximum velocity limits discussed above are selected empirically to maintain a suitable reduced velocity for the piston when it is within the "close" range. This reduced velocity is selected to provide accurate positioning when the piston is stopped by the routine. It is therefore believed that speed and accuracy are both benefited by using both coarse and fine positioning, as the majority of the motion of the mechanism 150 occurs at full speed, with the reduced speed being within the "close" range to improve the overall accuracy of the mechanism. It will be appreciated that various modifications may be made to boxing apparatus 100 and to the various routines executed therein consistent with the invention.

It has been found that the above positioning routine is capable of positioning the mechanisms of the preferred embodiments to within 1/16", and is able to maintain this accuracy and precision even when moving a full path of 13 inches in 1 second.

Therefore, it will be appreciated that significant gains in terms of productivity and reliability are gained through the use of the preferred packaging apparatus consistent with the invention. As various additional changes and modifications may be made to the preferred embodiments without departing from the spirit and scope of the invention, the invention therefore resides in the claims hereinafter appended.

What is claimed is:

1. An apparatus, comprising:

(a) a pneumatic cylinder having a piston segregating the cylinder into first and second chambers;

(b) first and second separate pneumatic pressure sources, coupled to the pneumatic cylinder, for respectively pressurizing the first and second chambers to move the piston within the cylinder, said first pneumatic pressure source providing a variable pressure to said first chamber and said second pneumatic pressure source providing a constant pressure to said second chamber; and (c) a controller, coupled at least to the first pressure source, for moving the piston to one of a plurality of positions in the cylinder, the controller including:

(1) a position sensor for detecting the position of the piston in the cylinder;

(2) a velocity sensor for detecting the velocity of the piston in the cylinder; and (3) positioning means, coupled to the position and velocity sensors, for controlling the first pressure source to position the piston to a desired position in the cylinder in response to the position and velocity of the piston.

2. The apparatus of claim 1, wherein the first pressure source is a proportional pressure control valve.

3. The apparatus of claim 1, wherein the velocity sensor comprises means for calculating the difference between first and second positions sensed by the position sensor at first and second times, respectively.

4. The apparatus of claim 3, wherein the position sensor comprises a string potentiometer coupled between the piston and a fixed point.

5. The apparatus of claim 1, wherein the positioning means includes:

(a) coarse positioning means for controlling the first pressure source to move the piston at a first velocity when the piston is beyond a close position proximate the desired position; and (b) fine positioning means for controlling the first pressure source to move the piston at a second velocity when the piston is within the close position, wherein the second velocity is lower than the first velocity.

6. The apparatus of claim 5, wherein the coarse positioning means controls the first pressure source to move the piston at full velocity, and wherein the fine positioning means maintains the velocity of the piston between minimum and maximum limits proximate the second velocity.

7. The apparatus of claim 6, wherein the positioning means determines when the piston is in the desired position by determining whether the position of the piston is within a window surrounding the desired position.

8. An apparatus for transferring a stack of articles to one of a plurality of stack positions in a box, the apparatus comprising:

(a) a hand assembly for gripping the stack of articles;

(b) stack position selecting means for orienting the hand assembly to one of the plurality of stack positions in the box, the stack position selecting means including:

(1) a pneumatic cylinder, coupled to the hand assembly, for moving the hand assembly along a predetermined axis, the pneumatic cylinder having a piston segregating the cylinder into first and second chambers; and (2) first and second pressure sources, coupled to the pneumatic cylinder, for respectively pressurizing the first and second chambers to move the piston within the cylinder; and (c) control means for coordinating activation of the hand assembly and the stack position selecting means to transfer the stack of articles to one of the plurality of stack positions in the box, wherein the control means is coupled at least to the first pressure source for moving the piston to one of a plurality of positions in the cylinder corresponding to at least a portion of the plurality of stack positions in the box, the control means including:

(1) a position sensor for detecting the position of the piston in the cylinder;

(2) a velocity sensor for detecting the velocity of the piston in the cylinder; and (3) positioning means, coupled to the position and velocity sensors, for controlling the first pressure source to position the piston to a desired position in the cylinder in response to the position and velocity of the piston.

9. The apparatus of claim 8, further comprising web transfer means, coupled to the control means, for loading a web into a box before the hand assembly transfers stacks of articles into the box, and for removing the web after the hand assembly has completed transferring stacks of articles into the box, wherein the web includes a plurality of dividers which cooperatively form a plurality of compartments in the box which correspond to the plurality of stack positions in the box.

10. The apparatus of claim 8, wherein the hand assembly includes a plurality of fingers for gripping the stack of articles, the apparatus further comprising:

(a) finger activating means for activating the fingers to selectively grip the stack of articles;

(b) hand tilting means for tilting the hand assembly between first and second orientations, the first orientation being substantially vertical and the second orientation being inclined relative to the first orientation; and (c) hand extending means for moving the hand assembly between first and second positions along a longitudinal axis of the hand assembly.

11. A method of controlling a pneumatic cylinder having a piston segregating the cylinder into first and second chambers, the pneumatic cylinder coupled to first and second separate pneumatic pressure sources respectively pressurizing the first and second chambers to move the piston within the cylinder, the first pneumatic pressure source providing a variable pressure and the second pneumatic pressure source providing a constant pressure, the method comprising the steps of:

(a) monitoring the position of the piston in the cylinder;

(b) monitoring the velocity of the piston in the cylinder;

(c) applying the constant pressure to the second chamber using the second pneumatic pressure source; and (d) moving the piston to a selected position by controlling the first pneumatic pressure source to thereby vary the pressure in the first chamber to move the piston at a first velocity when the piston is outside of a close position proximate the selected position, and to move the piston at a second, lower velocity when the piston is intermediate the close position and the selected position.

* * * * *